US010143284B2

(12) United States Patent
Depoyian

(10) Patent No.: US 10,143,284 B2
(45) Date of Patent: Dec. 4, 2018

(54) HAIR DRYER APPARATUS

(71) Applicant: Jacques Depoyian, Denver, CO (US)

(72) Inventor: Jacques Depoyian, Denver, CO (US)

( * ) Notice: Subject to any disclaimer, the term of this patent is extended or adjusted under 35 U.S.C. 154(b) by 326 days.

(21) Appl. No.: 15/218,018

(22) Filed: Jul. 23, 2016

(65) Prior Publication Data

US 2016/0324292 A1 Nov. 10, 2016

Related U.S. Application Data

(63) Continuation-in-part of application No. 14/656,675, filed on Mar. 12, 2015, now abandoned.

(51) Int. Cl.

| | |
|---|---|
| ***A45D 20/12*** | (2006.01) |
| ***B26B 19/38*** | (2006.01) |
| ***A45D 2/00*** | (2006.01) |
| ***A45D 1/04*** | (2006.01) |
| ***A45D 2/40*** | (2006.01) |
| ***A45D 20/50*** | (2006.01) |

(52) U.S. Cl.

CPC ..... *A45D 20/12* (2013.01); *A45D 1/04* (2013.01); *A45D 2/001* (2013.01); *A45D 2/40* (2013.01); *A45D 20/50* (2013.01); *B26B 19/3873* (2013.01)

(58) Field of Classification Search

CPC ..... A45D 20/12; A45D 1/04; A45D 2/001; A45D 2/40; A45D 20/50; B26B 19/3873

USPC ..... 34/95–100

See application file for complete search history.

(56) References Cited

U.S. PATENT DOCUMENTS

| | | | | | |
|---|---|---|---|---|---|
| 3,846,047 | A | * | 11/1974 | Wada | A45D 20/10 34/201 |
| 3,890,984 | A | * | 6/1975 | Lesetar | A45D 20/50 132/238 |
| 4,198,556 | A | * | 4/1980 | Crowley | A45D 20/12 132/212 |
| 5,467,540 | A | * | 11/1995 | Bastien | A45D 20/122 34/283 |
| 5,636,815 | A | * | 6/1997 | Wilson | A45D 20/12 248/125.3 |
| 5,649,370 | A | * | 7/1997 | Russo | A45D 20/12 34/97 |
| 5,832,624 | A | * | 11/1998 | Narrin | A45D 20/12 34/97 |

(Continued)

*Primary Examiner* — Stephen M Gravini
(74) *Attorney, Agent, or Firm* — Roger A. Jackson

(57) ABSTRACT

A hair dryer apparatus includes a housing with a surrounding sidewall having an inner surface defining an interior and an opposing outer surface, further the sidewall having an inlet and an opposing outlet. In addition, the hair dryer apparatus includes a motor driven blower disposed within the interior, the blower drives airflow from the inlet to the outlet. Additionally, the hair dryer apparatus includes a handle in the form of a clevis shape with the clevis shape having a pair of symmetrically opposed arcuate extensions that have a common origination from a handle stem extension portion that has an opposing free end portion, each arcuate extension terminates in a pivotal connection to the inlet outer surface, the pivotal connections are about a pivotal axis. Operationally, the handle stem extension in a longwise manner has a pivotal movement range from being co-axial to the airflow to being perpendicular to the airflow.

12 Claims, 23 Drawing Sheets

(56) References Cited

U.S. PATENT DOCUMENTS

| | | | | | |
|---|---|---|---|---|---|
| 5,884,008 | A * | 3/1999 | Goldberg | A45D 20/12 | 206/320 |
| 5,987,772 | A * | 11/1999 | Cheng | A45D 20/06 | 34/96 |
| 6,067,724 | A * | 5/2000 | Depoyian | A45D 20/12 | 34/97 |
| 6,199,295 | B1 * | 3/2001 | Smal | A45D 20/122 | 34/98 |
| 6,205,679 | B1 * | 3/2001 | Rodway | F26B 21/001 | 34/487 |
| 6,671,460 | B1 * | 12/2003 | Smal | A45D 20/12 | 200/18 |
| 6,725,562 | B2 * | 4/2004 | Nakagawa | A45D 20/12 | 34/96 |
| 6,763,606 | B2 * | 7/2004 | Saida | A45D 20/00 | 34/96 |
| 8,122,566 | B2 * | 2/2012 | Sepke | A47L 5/32 | 15/331 |
| 8,302,324 | B1 * | 11/2012 | Connelly | A45D 20/12 | 132/118 |
| 8,407,913 | B2 * | 4/2013 | Langley | A45D 20/12 | 132/271 |
| 8,707,577 | B2 * | 4/2014 | Lee | A45D 20/12 | 132/212 |
| 8,813,384 | B2 * | 8/2014 | Correll, Jr. | A45D 20/12 | 34/96 |
| 9,408,452 | B1 * | 8/2016 | Al-Khulaifi | A45D 20/12 | |
| 2010/0089413 | A1 * | 4/2010 | Wright | A45D 2/001 | 132/211 |
| 2016/0262520 | A1 * | 9/2016 | Depoyian | A45D 20/12 | |
| 2016/0324292 | A1 * | 11/2016 | Depoyian | A45D 20/50 | |

* cited by examiner

HAIR DRYER APPARATUS

RELATED PATENT APPLICATION

This is a continuation in part (CIP) patent application of U.S. patent application Ser. No. 14/656,675 filed on Mar. 12, 2015 by Jacques Depoyian et al., of Denver, Colo., U.S.

TECHNICAL FIELD

The present invention relates generally to a hair dryer apparatus that is hand held for the purpose of drying human hair. More particularly, the present invention of the portable hair dryer apparatus has a pivotally adjustable handle, interchangeable brush heads, and noise attenuation features.

BACKGROUND OF INVENTION

Hair dryers that are portable and hand-held typically have two classifications, a first classification being for personal individual use and a second for professional salon use. The personal use hair dryer is usually used once daily in a person's home, wherein the design objective is primarily low cost resulting in minimal features suitable for the occasional use of the hair dryer by the individual. Thus, the personal hair dryer would have a simple fixed integral handle, no removably engagable brush attachments, lack any provision for sound attenuation, and further usually no effort is put into having an ergonomic handle that is designed to balance the center of gravity of the hair dryer for minimal hand and wrist fatigue.

Wherein, with the second classification for the professional hair dryer that would be typically used 30 or so times a day by the same stylist in a salon environment with numerous other stylists, thus using the hair dryer at a rate of about 30 times of what the personal hair dryer would be used by an individual. Thus, a number of additional factors come into play with the professional hair dryer, such as usage durability, hand and wrist stress/fatigue with holding and using the hair dryer many times per day in having issues similar to the well-known carpal-tunnel syndrome from a high number of repetitive hand and wrist motions, further the increased noise from up to 30 or so hair dryers operating simultaneously in the same environmental space can be also fatiguing as well as possibly causing hearing damage. As fan noise is primarily related to air velocity, such that higher velocity equals higher noise, which is what the personal hair dryers have to reduce costs, such that having smaller size air flow passageways reduces the housing size and cost while higher air velocity requires less heating element insulation also reducing cost, however, with the result that the hair dryer makes more noise. Thus the personal dryer outputs a high temperature flow of high velocity air that works well for what most personal users want being that the hair dryer is primarily a fast hair blow drying appliance and not primarily used for hair styling which would more encompass salon use.

Thus with the professional hair dryer, styling is more of a primary use, in desiring the removably engagable brushes, wherein slower drying of hair would also be desirable. Further, with the professional hair dryer an enhanced design could include features such as an ergonomically designed handle that through variable structure would be able to alter positional orientations as between the hair dryer outlet and the operator's hand and wrist to reduce fatigue of the hand and wrist. In addition, design could be done to attenuate the noise produced outside of the hair dryer enclosure or housing, and having removably engagable brushes for operator convenience to quickly and easily change brush types for hair styling. Naturally these enhancements to the professional hair dryer would add cost, however, it is anticipated that the professional operators or users would pay more for a value added product, being an analogy with mechanics tools, wherein the personal occasional tool user can get by with low quality low cost tools, wherein someone who makes their living using tools daily will benefit from higher quality tools and thus will pay for them.

In looking at the prior art in the hair dryer area, in U.S. Pat. No. 6,067,724 to Depoyian disclosed is a hair dryer that has interchangeable brush heads that are removably engagable to the dryer body, wherein the brush heads are hollow that allow the hair dryer air to flow therethrough the brush bristles, see FIGS. 1, 4, 8, and 9. In Depoyian, the hair dryer also can have a pivotable handle, see FIG. 11, that allows an electrical power wire through a slot to facilitate the handle pivotal movement in relation to the hair dryer body, see FIG. 14 with only the disclosed ability to lock the handle at only the in-line and right angle positions, see FIG. 2A. Further, in Depoyian the handle pivotal locks are structured to be V-shaped projections that are ninety degrees apart that are matched to a pair of recesses for the purpose of locking the pivotal handle in only the two positions only at the in-line and right angle, see FIGS. 11, 13, 14, and 15.

Further, in looking at the prior art in the hair dryer area, in U.S. Pat. No. 4,198,556 to Crowley, et al., disclosed is a hair-drying appliance having a cylindrical housing and a handle rotatably mounted at one end thereof for movement between a first position generally perpendicular to the housing and a second position in longitudinal alignment with the housing. In Crowley, a single locking lever is provided for latching the handle in either of its positions wherein the appliance has a first air outlet at one end of the cylindrical housing and a second air outlet in the side wall of the housing adjacent the first air outlet. Further, in Crowley an adaptor, which is mountable on the housing adjacent the second air outlet only when the handle is in its second aligned position, has a plate portion for blocking the first air outlet and means for supporting comb and brush attachments thereon. Crowley has a two position handle being for use as a pistol gun type handle arrangement or as an elongated straight bodied dryer only. Crowley also teaches multiple attachments for brushes and combs that the air can blow therethrough.

Continuing, in the portable hair dryer arts, in U.S. Pat. No. 3,846,047 to Wada, et al., disclosed is a foldable hair dryer consisting of a hollow nozzle assembly made up of a cylindrical portion and tangentially extending nozzle coaxially fitted into a handle assembly having a cylindrical portion and tangentially extending handle, the two assemblies being generally symmetrical. In Wada, the thickness of the nozzle, handle and their associated cylindrical portions, measured axially, is approximately the same resulting in a compact, "flat" construction, see in particular FIG. 3.

Further in Wada, within the cylindrical portion of the nozzle assembly is mounted a motor and fan assembly also of "flat" configuration in which the blades of the fan are peripherally disposed about the motor wherein the nozzle is fitted with a heating element. The nozzle and handle assemblies in Wada are coaxially pivoted for movement between an operating condition, see FIG. 2 in which the nozzle and handle are in "L" configuration and a collapsed condition in which the nozzle and handle lie compactly side by side, see FIG. 3. Also, in Wada a switch on the handle is operated by the nozzle incident to the collapsing movement to insure that the motor and heating element are both turned off in the collapsed state, again see FIGS. 2 and 3. Thus in Wada the hair dryer is only foldable for portability purposes.

Moving onward in the portable hair dryer arts, in U.S. Pat. No. 8,813,384 to Correll, Jr., et al., disclosed is a hair dryer having a handle that may both be pivoted toward the dryer housing, and rotated with respect to the dryer housing so that the dryer may easily be operated in either a handle-held or nozzle-held mode, wherein the handle has two pivotal axes of movement. The hair dryer in Correll includes a dual axis joint assembly connecting the handle to the dryer housing that allows the handle to be rotated around its longitudinal axis before or during the time it is pivoted toward the dryer housing so that the control switch remains exposed and operable by a user when the handle is pivotally folded against the dryer body in preparation for nozzle-held operation, see FIGS. 6, 7, 11A, and 11B.

The dual axis joint assembly in Correll may include an eccentric mechanism that converts pivoting movement of the handle toward and away from the housing into rotational movement of said handle so that the handle turns 90 degrees when pivotally folded against the dryer housing, see the pictorial sequence in going from FIGS. 10 to 11A to 11B to 12. Additionally, Correll has the electrical cord connection for supplying power to the blower assembly within the dryer housing is mounted on the blower assembly portion of the housing opposite the nozzle instead of on the handle so that the electrical cord does not interfere with the nozzle held operation of the dryer, see FIG. 10. The primary advantage that Correll teaches is the adjustable movement of the control switches through handle rotational movement that is convenient when assuming different hand hold positions about the handle.

Next, in the portable hair dryer appliance arts specifically relating to noise reduction, in U.S. Pat. No. 8,307,948 to Parodi disclosed is a noise silencer device for a hair dryer that comprises a container structure exhibiting a plurality of inlet openings, an outlet opening, and a conduit connecting the inlet and outlet openings to one another and further comprising a ring made of sound-absorbent material that is inserted in the conduit such as to interfere with a flow of air between the inlet openings and the outlet opening in such a way as to at least partly attenuate sound vibrations associated to the air flow. The inlet openings in Parodi are made on a lateral wall of the container structure and face the axis such as to define an air flow along a first transversal direction to the axis such as to define a flow of air along a first transversal direction to the axis, and deviating means arranged in the conduit impress an axial deviation along the axis on the air flow coming from the inlet openings. Thus Parodi utilizes sound attenuation with enclosure modifications as opposed to reducing sound at the root source, wherein the teaching is strictly related to the inlet of the hair dryer via dampening noise vibrations within the inlet housing.

Further, in the hair dryer arts, again specifically relating to noise reduction, in U.S. Pat. No. 6,011,903 to Nosenchuck, disclosed an axial flow hair dryer that comprises a generally circular main housing with a transitional portion that smoothly reduces the housing diameter to an outlet. Nosenchuck has a first fan stage in the main housing generates an axial air flow through the housing, wherein an outer duct has two axial extensions secured to the housing near the beginning of the transitional portion, and the housing air outlet introduces air exiting the housing into the outer duct. The housing in Nosenchuck and the outer ducts form two additional ambient air intakes extending between the axial extensions in a smooth arc toward the main housing outlet with a second fan stage that includes a second axial flow impeller in the outer duct for generating air flow through the ambient air intake.

In Nosenchuck, the second axial flow impeller includes inner and outer blades separated by an annular shroud that forms an extension of the main housing flow passage. A guide duct in Nosenchuck, being in the outer duct forms a further extension of the extended air flow passage, and the guide duct includes stator vanes at its outlet. Further, Nosenchuck has a handle depending from the main housing that holds a motor and a flex shaft that connects the motor to a drive shaft that carries both fan stages. In addition, Nosenchuck has resistance heating wires in the main housing heat the air flowing through the hair dryer. Nosenchuck increases the mass flow rate of air via a two stage axial fan, thus reducing the need for higher rotating speed fans which of course helps keep the noise down.

What is needed is a hair dryer apparatus that is specifically designed for the professional salon user market having a multiple adjusting handle, balanced center of gravity design both for minimizing hand and wrist fatigue during frequent repeated uses. In addition, to accommodate hair styling and drying with removably engagable brushes, plus noise attenuation features for facilitating a more pleasing environment wherein numerous portable hair dryers are in use simultaneously in the same environmental space, such as in a salon.

SUMMARY OF INVENTION

Broadly, the present invention is a hair dryer apparatus that includes a housing with a surrounding sidewall that is about a longitudinal axis, the surrounding sidewall having an inner surface portion defining a sidewall interior and the surrounding sidewall having an opposing outer surface portion, further the surrounding sidewall having an inlet portion and an opposing outlet portion with the longitudinal axis spanning therebetween. In addition, the hair dryer apparatus includes a motor driven blower disposed within the surrounding sidewall interior; the blower is operational to drive airflow from the inlet portion therethrough the sidewall interior to the outlet portion.

Further included in the hair dryer apparatus includes is a handle in the form of a clevis shape with the clevis shape having a pair of symmetrically opposed arcuate extensions that have a common origination from a handle stem extension portion. Wherein the stem extension portion has an opposing free end portion, also each of the arcuate extensions terminate in a pivotal connection to the sidewall outer surface portion of the inlet portion, wherein the pivotal connections are along a common pivotal axis. Wherein operationally, the handle stem extension portion in a longwise manner along a longwise axis has a pivotal movement range from being co-axial to the longitudinal axis to being substantially perpendicular to the longitudinal axis.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 5 shows cross sectional cut 5-5 from FIG. 4, wherein FIG. 5 shows detail of the inlet end portion of the sidewall that includes the annular baffle, the blower, the motor, the fluid communication from the external environment to the sidewall interior that goes into the inlet chamber, then to the central portion of the blower via an airflow transition then to an outer portion of the blower wherein sound abatement occurs, and then the airflow fluid communication going to the sidewall interior;

FIG. 11 shows cross section cut 11-11 from FIG. 10, wherein FIG. 11 shows the outlet end portion of the surrounding sidewall that includes the brush engaged to the grille structure for removable engagement on the outlet margin of the surrounding sidewall that shows in particular the brush bristles, the brush interior void, the radial openings in the brush, and the airflow in relation to the bristles, radial opening, and hair is shown;

FIG. 12 shows an exploded perspective view of FIG. 11, wherein FIG. 12 shows the outlet end portion of the surrounding sidewall that includes the brush disengaged to the grille structure for removable engagement adjacent to the outlet margin of the surrounding sidewall that shows in particular the brush bristles, the hair wrapped around the brush bristles, the brush interior void, the radial openings in the brush, and the removing and engaging of the brush to the outlet margin structure;

FIGS. 14A and 14B show from an end view, also showing the "L" shaped twist lock that is used for both the wide and narrow channels that receives the wide and narrow protrusions via the turn movement to effectuate the locking axially of the male and female elements to one another while at the same time allowing electrical communication as between the primary contact and the first conductor contact plus the secondary conductor contact is in electrical communication with the second conductor contact, and the tertiary conductor contact is in electrical communication with the third conductor contact.

REFERENCE NUMBERS IN DRAWINGS

Figure 1:
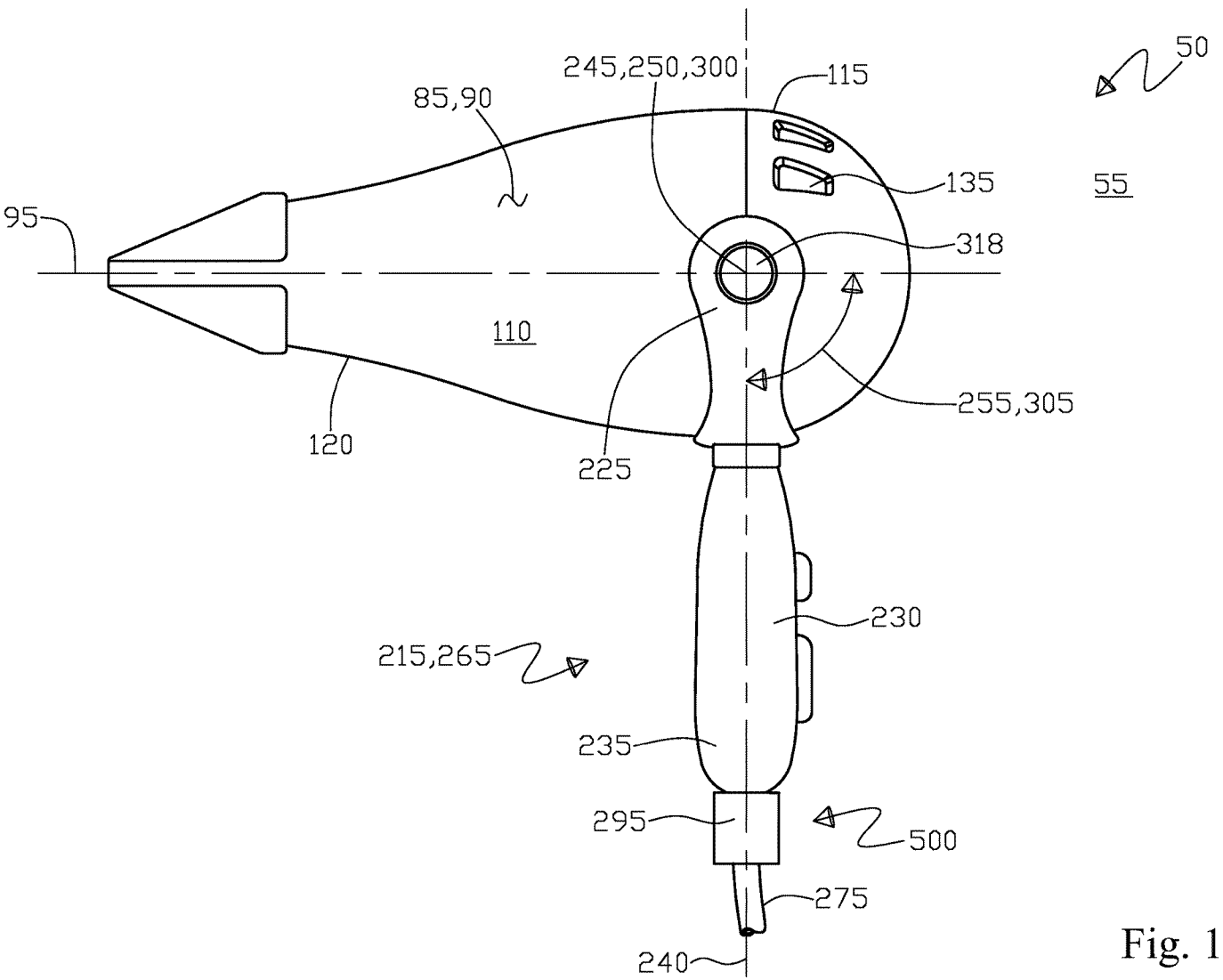
FIG. 1 shows a side elevation view of the hair dryer apparatus that includes the housing, the handle that is in the perpendicular position of the longwise axis and the longitudinal axis, the inlet and outlet portions of the surrounding sidewall, and the structure for removable engagement of the electrical power communication.

50 Hair dryer apparatus
55 External environment
60 Hair
65 Brush
70 External bristles of the brush 65
75 Interior void of the brush 65
80 Plurality of radial openings of the brush 65
85 Housing
90 Surrounding sidewall of the housing 85
95 Longitudinal axis of the surrounding sidewall 90
100 Inner surface portion of the surrounding sidewall 90
105 Interior of the surrounding sidewall 90
110 Outer surface portion of the surrounding sidewall 90
115 Inlet portion of the surrounding sidewall 90
120 Outlet portion of the surrounding sidewall 90
125 Outlet margin of the sidewall outlet 120
130 Structure to accommodate a removable engagement of the brush 65 with the structure 130 preferably in the form of a hex receptacle
131 Hex protrusion of the brush 65 to be received in hex receptacle 130
132 Magnetic shoulder of hex protrusion 131 to make brush 65 removably engagable to grille 400
135 Radial mouth opening
140 Mouth axis of the radial mouth opening 135
145 Fluid communication from the external environment 55 to the sidewall interior 105
150 Annular baffle
155 Outer periphery of the annular baffle 150
160 Inner opening of the annular baffle 150
165 Inlet chamber
170 Fluid communication from the external environment 55 to the inlet chamber 165
175 Directing airflow to a central portion 200 of the blower 195
180 Sound abatement barrier as between the mouth 135 and the blower 195
185 Airflow transition from parallel to the mouth 135 axis 140 to parallel to the longitudinal axis 95 from the annular baffle 150
190 Motor
195 Blower
200 Central portion of the blower 195
205 Outer portion of the blower 195
210 Airflow
215 Handle
220 Clevis shape of the handle 215
225 Arcuate extension of the handle 215
230 Stem extension portion of the handle 215
235 Free end portion of the stem extension portion 230
240 Longwise axis of the stem extension portion 230
245 Pivotal attachment connection of the arcuate extension 225 to the outer surface portion 110
250 Pivotal axis of the pivotal connection 245
255 Pivotal movement range
260 Co-axial or parallel position of the longwise axis 240 to the longitudinal axis 95
265 Perpendicular position of the longwise axis 240 to the longitudinal axis 95
270 Electrical communication rotatable couple
275 Corded electrical power communication
280 Electrically conductive concentric slip rings
285 Electrically conductive fingers
290 Sliding of the fingers 285 as against the concentric slip rings 280
295 Structure for removable engagement of the electrical power communication 275 using the twist lock removably engagable electrical plug assembly 500
300 Means for locking 321 and unlocking 322 the pivotal movement within the pivotal movement range 255
305 Plurality of selectable positions of the handle 215 about the pivotal movement range 255
310 Plurality of removable engagable teeth of the clevis 220
311 Rotational 255 engagement of the clevis 220
315 Plurality of mating to 310 removably engagable teeth of the outer surface
316 Rotational 255 engagement of the outer surface 110
317 Flexible link as between rotational engagement 316 and outer surface 110
318 Button of rotational engagement 316
319 Movement of the button 318
320 Fluid communication as between the sidewall interior 105 and the interior void 75
321 Closed engaged state as between rotational engagement 311 and rotational engagement 316 preventing rotational movement 255
322 Open disengaged state as between rotational engagement 311 and rotational engagement 316 allowing for rotational movement 255
323 Pivotal interface as between clevis 220 and rotational engagement 316 of the outer surface 110 via button 318 for movement 255

324 Movement of clevis 220 for movement as between closed state 321 and open state 322
325 Fluid communication as between the interior void 75 to the bristles 70 of the brush 65 via the radial openings 80 to the hair 60
326 Movement of rotational engagement 316 through flexible link 317 via button 318 and movement 319 to move between the open state 322 and closed state 321
330 Wrapping a portion of a head of hair 60 about the hair brush 65 so that a portion of the hair 60 is in contact with the bristles 70
335 Activating the blower 195 to drive airflow 320 therethrough the portion of the hair 60 is in contact with the bristles 70
340 Removing the brush 65 from the outlet margin 125 structure 130 of the hair dryer apparatus 50, wherein the hair 60 wrapped about the brush 65 stays in place with the brush 65 staying on the head of hair 60
345 Grasping an additional unused brush 65 and engaging the unused brush 65 to the outlet margin 125 structure 130
400 Outlet grille
500 Twist lock removably engagable electrical plug assembly
505 Male insert element of twist lock assembly 500
510 Female receptacle element of twist lock assembly 500
515 Inset 505 axial movement
520 Partial turn of element 505 to lock the male 505 and female 510 elements axially wherein turn 520 is preferably about ⅛ (45 degrees) of a circular rotation
525 Wide channel
530 Narrow channel
535 Female annular cavity
536 Female inner cylinder
540 First conductor contact
545 Second conductor contact
550 Third conductor contact
555 Female inner bore
560 Wide protrusion
565 Narrow protrusion
570 Outside diameter of male element 505
571 Male outer cylinder
575 Male element 505 annular cavity
580 Primary conductor contact
585 Secondary conductor contact
590 Tertiary conductor contact
595 Cylinder of male element 505
596 "L" shaped twist lock channel for both the wide channel 525 and the narrow channel 530
600 Flat iron
605 Handle of the flat iron 600
610 Curling iron
615 Handle of the curling iron 610
620 Crimping iron
625 Handle of the crimping iron 620
630 Hair clipper
635 Handle for the clipper 630

DETAILED DESCRIPTION

Figure 2:
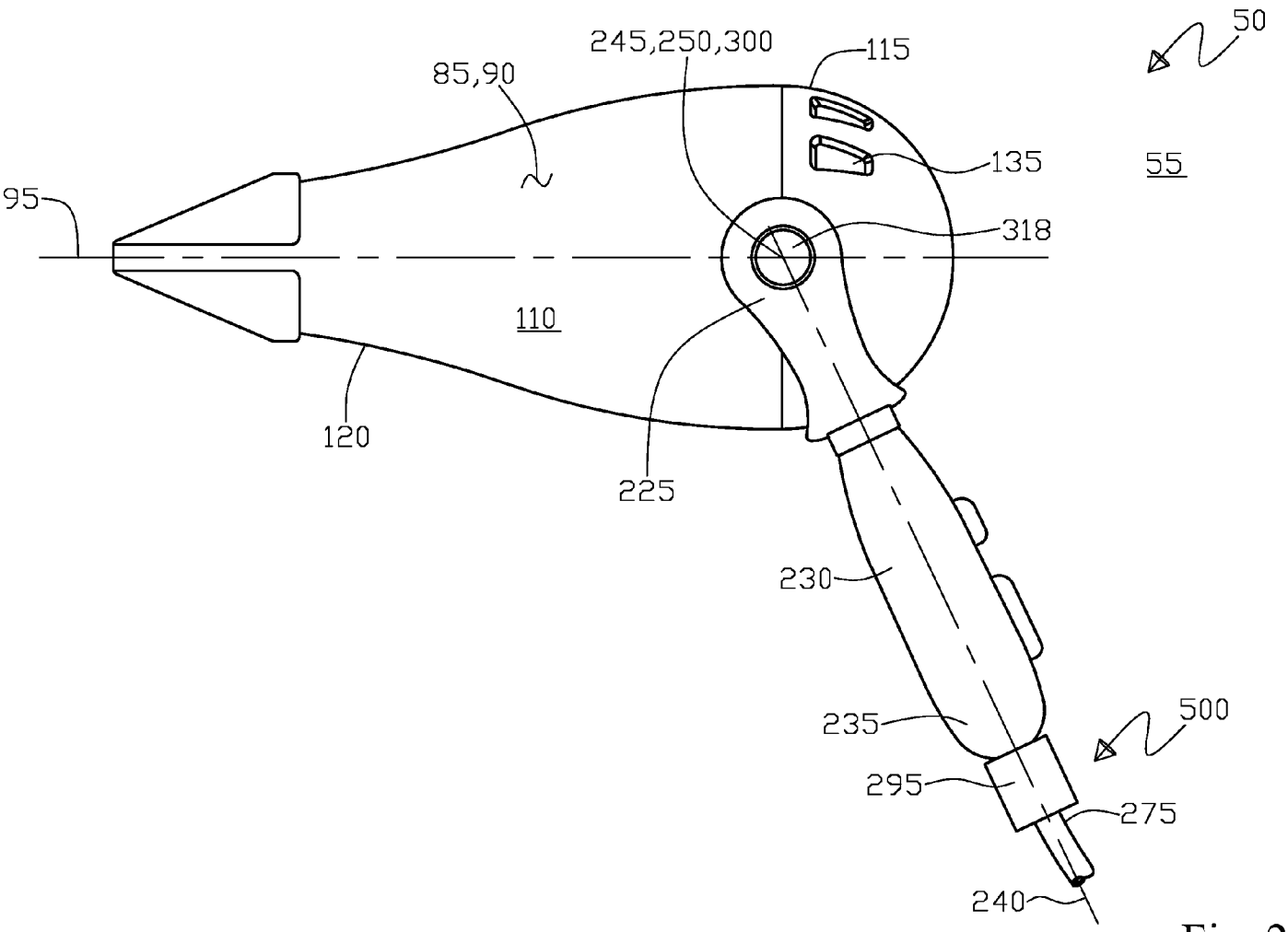
FIG. 2 shows a side elevation view of the hair dryer apparatus that includes the housing, the handle that is in-between the perpendicular and parallel positions of the longwise axis and the longitudinal axis, the inlet and outlet portions of the surrounding sidewall, and the structure for removable engagement of the electrical power communication.

With initial reference to FIG. 1, shown is a side elevation view of the hair dryer apparatus 50 that includes the housing 85, the handle 215 that is in the perpendicular position 265 of the longwise axis 240 and the longitudinal axis 95, the inlet 115 and outlet 120 portions of the surrounding sidewall 90, and the structure 295 for removable engagement of the electrical power communication 275. Next, FIG. 2 shows a side elevation view of the hair dryer apparatus 50 that includes the housing 85, the handle 215 that is in-between the perpendicular 265 and parallel 260 positions of the longwise axis 240 and the longitudinal axis 95, the inlet 115 and outlet 120 portions of the surrounding sidewall 90, and the structure 295 for removable engagement of the electrical power communication 275.

Figure 3:
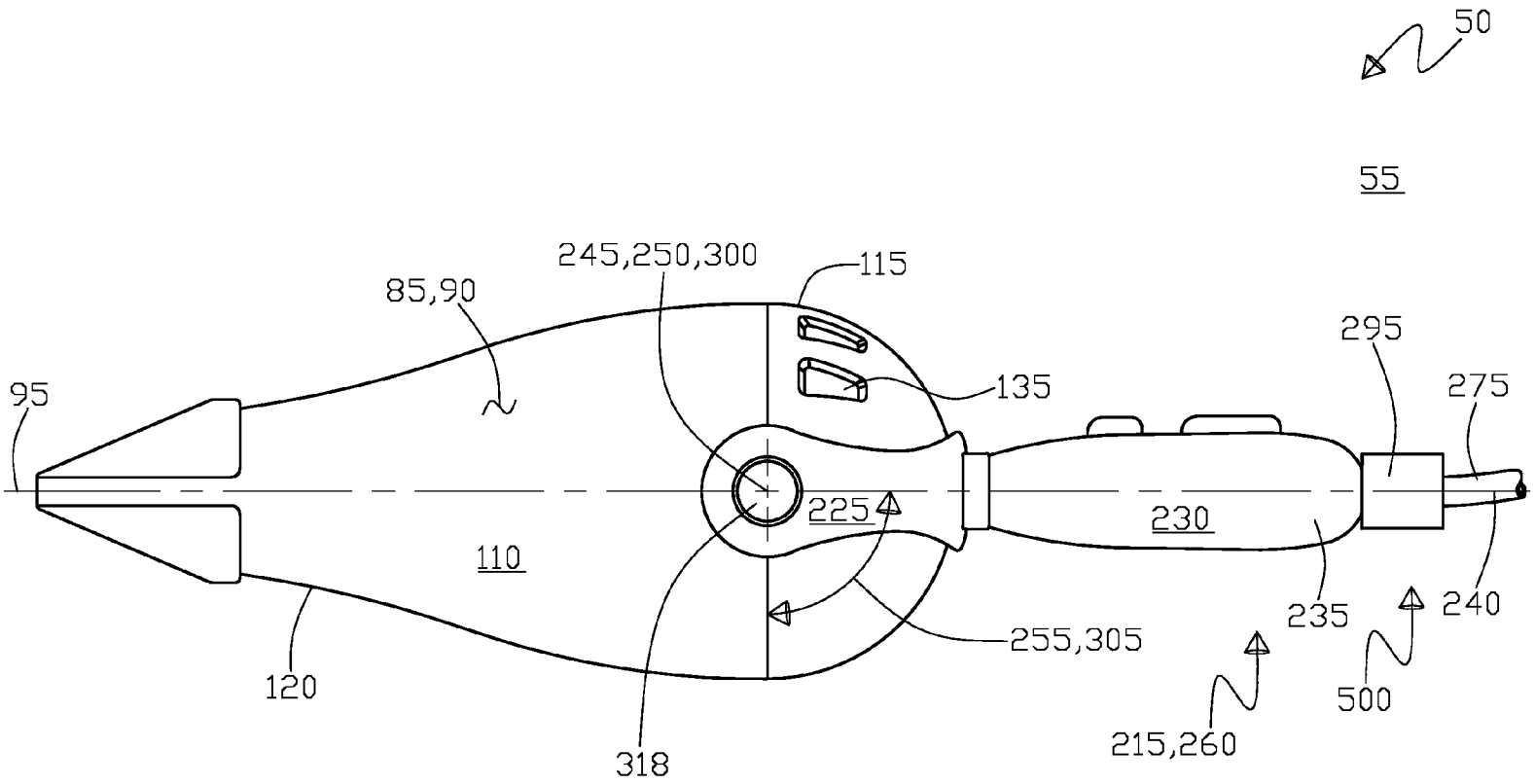
FIG. 3 shows a side elevation view of the hair dryer apparatus that includes the housing, the handle that is in the parallel or co-axial position of the longwise axis and the longitudinal axis, the inlet and outlet portions of the surrounding sidewall, and the structure for removable engagement of the electrical power communication.

Continuing, FIG. 3 shows a side elevation view of the hair dryer apparatus 50 that includes the housing 85, the handle 215 that is in the parallel or co-axial position 260 of the longwise axis 240 and the longitudinal axis 95, the inlet 115 and outlet 120 portions of the surrounding sidewall 90, and the structure 295 for removable engagement of the electrical power communication 275. Further, FIG. 4 shows a perspective view of the hair dryer apparatus 50 that includes the housing 85, the handle 215 that is in the parallel or co-axial position 260 of the longwise axis 240, and the longitudinal axis 95, the inlet 115 and outlet 120 portions of the surrounding sidewall 90, and the structure 295 for removable engagement of the electrical power communication 275.

Figure 4:
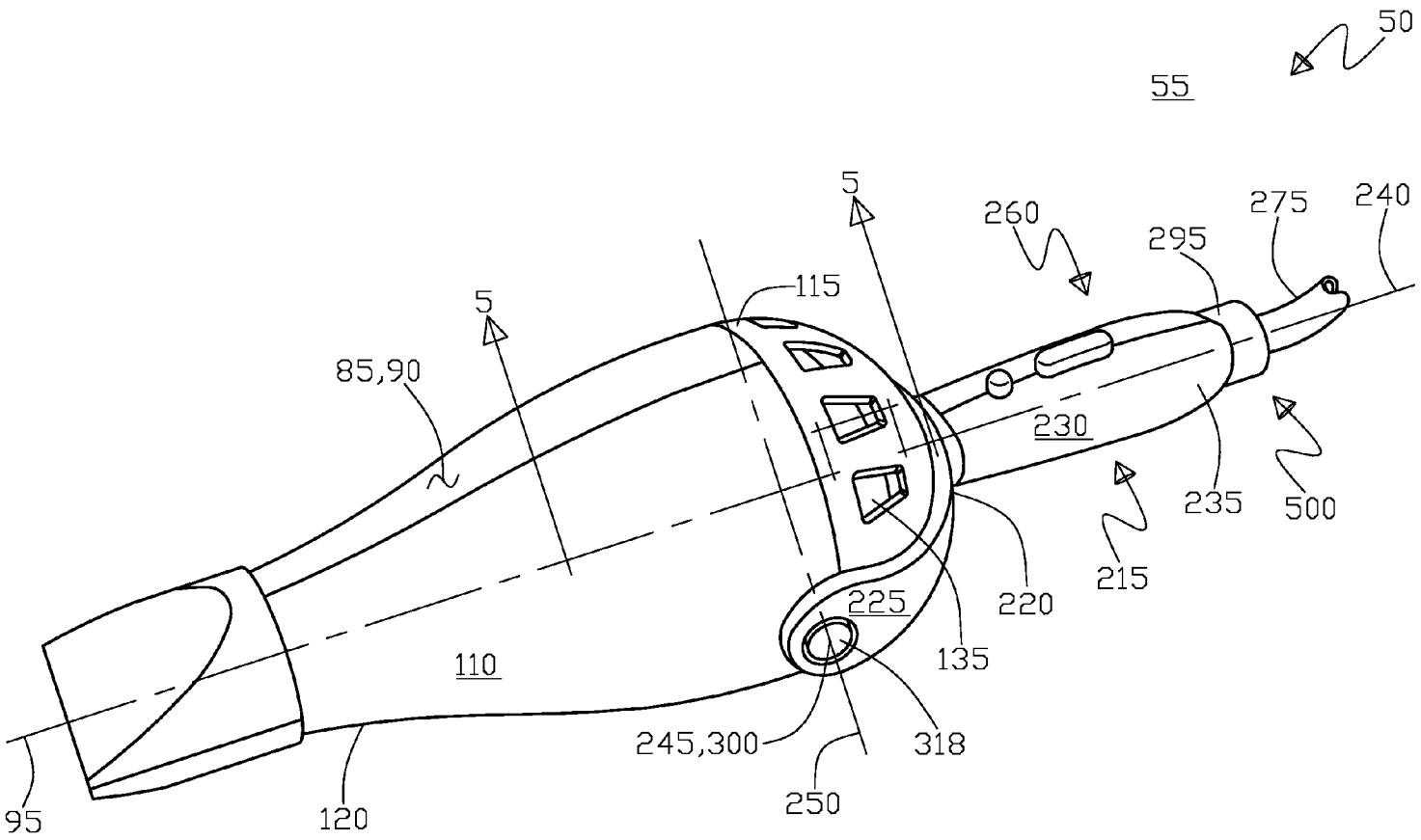
FIG. 4 shows a perspective view of the hair dryer apparatus that includes the housing, the handle that is in the parallel or co-axial position of the longwise axis and the longitudinal axis, the inlet and outlet portions of the surrounding sidewall, and the structure for removable engagement of the electrical power communication.
Figure 5:
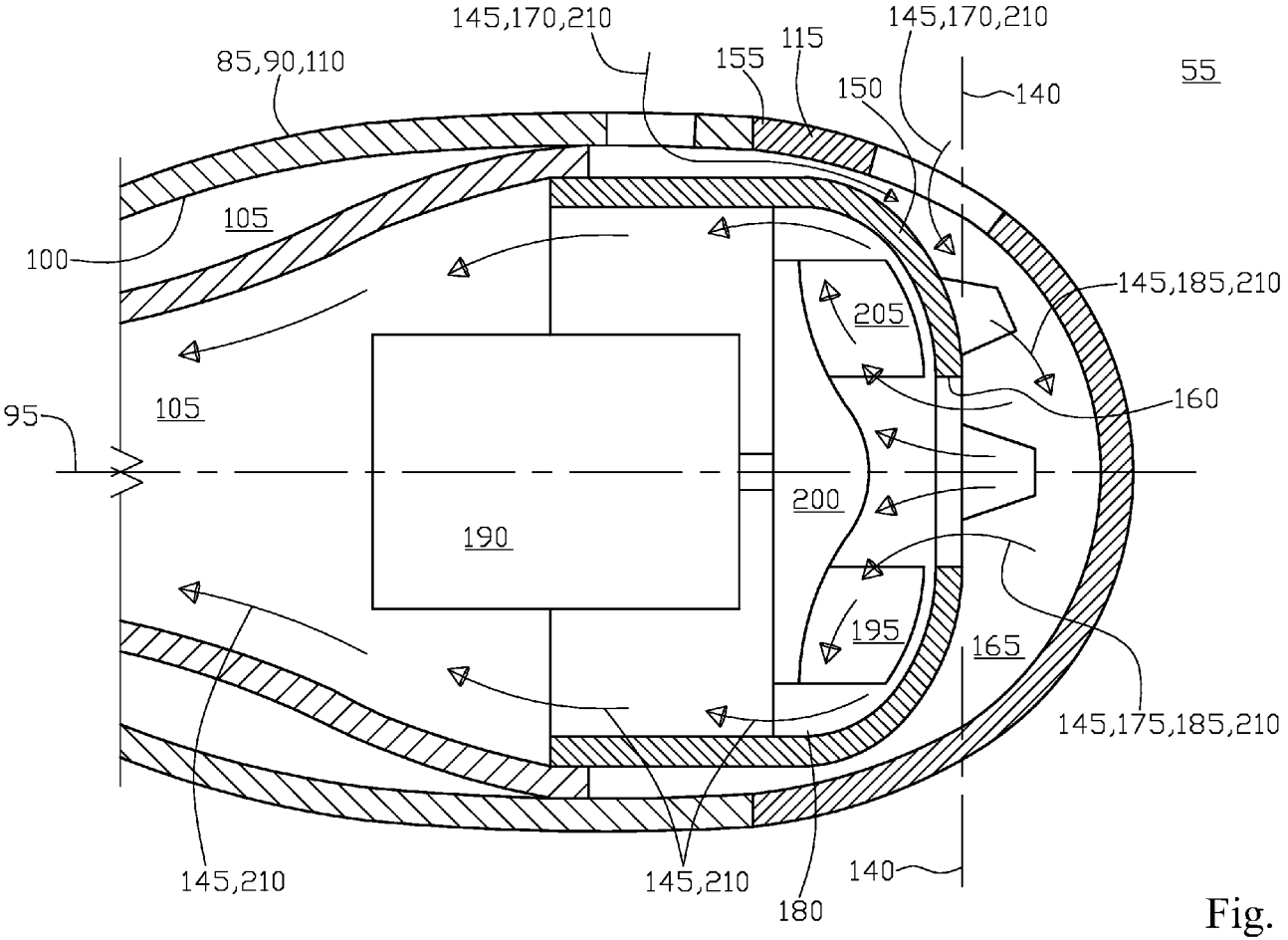
Figure 6:
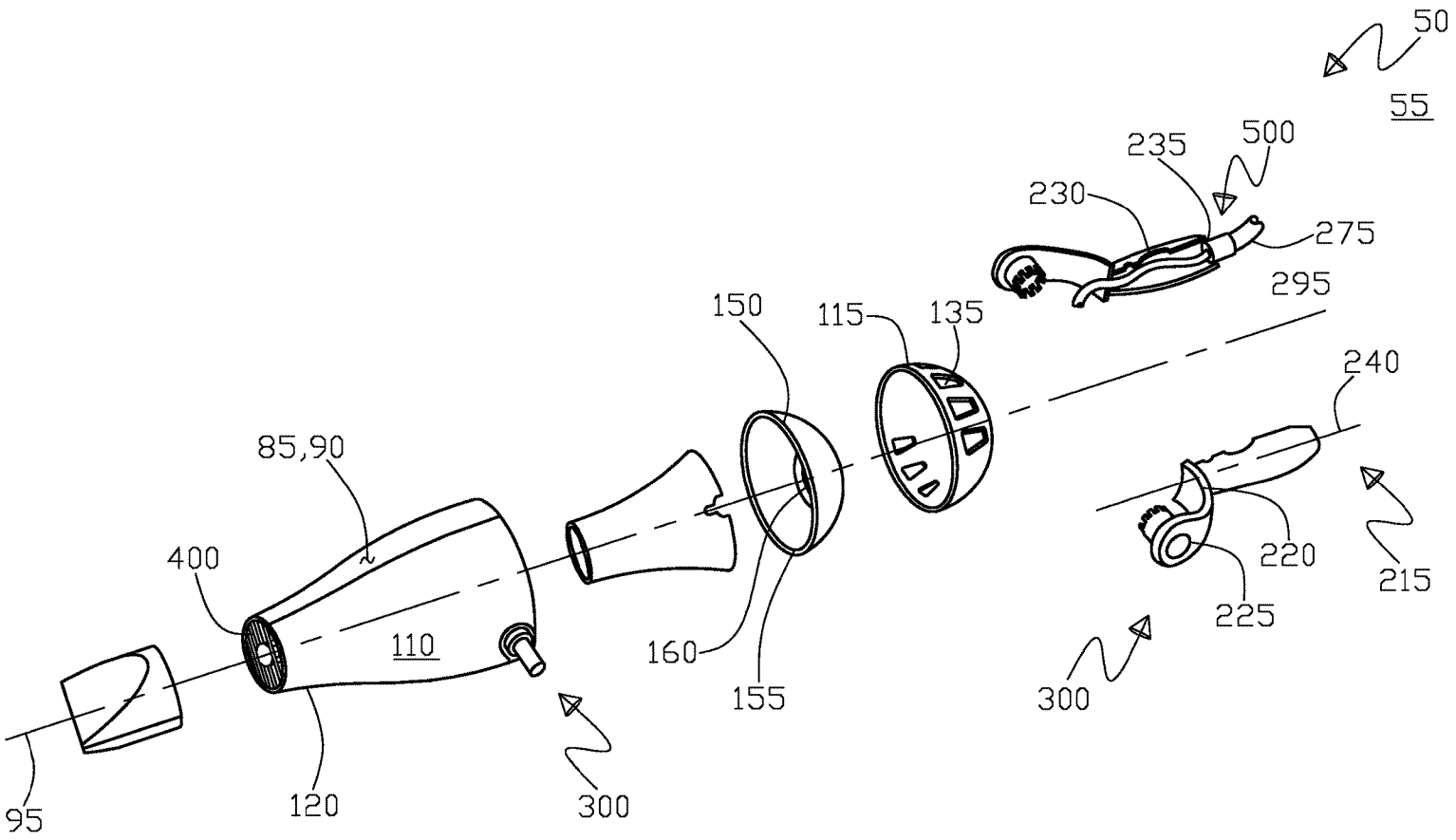
FIG. 6 shows an exploded perspective view of the hair dryer apparatus that includes the housing, the handle that is in the parallel or co-axial position of the longwise axis and the longitudinal axis, the inlet and outlet portions of the surrounding sidewall, the annular baffle, the structure for removable engagement of the brush, and the structure for removable engagement of the electrical power communication.

Moving onward, FIG. 5 shows cross sectional cut 5-5 from FIG. 4, wherein FIG. 5 shows detail of the inlet end portion 115 of the sidewall 90 that includes the annular baffle 150, the blower 195, the motor 190, the fluid communication 145 from the external environment 55 to the sidewall interior 105 that goes into the inlet chamber 165, then to the central portion 200 of the blower 195 via an airflow 175 transition 185 then to the outer portion 205 of the blower 195 wherein sound abatement 180 occurs, and then the airflow 210 fluid communication going to the sidewall interior 105. Continuing, FIG. 6 shows an exploded perspective view of the hair dryer apparatus 50 that includes the housing 85, the handle 215 that is in the parallel or co-axial position 260 of the longwise axis 240 and the longitudinal axis 95, the inlet 115 and outlet 120 portions of the surrounding sidewall 90, the annular baffle 150, the structure 130 for removable engagement of the brush 65, and the structure 295 for removable engagement of the electrical power communication 275.

Figure 7:
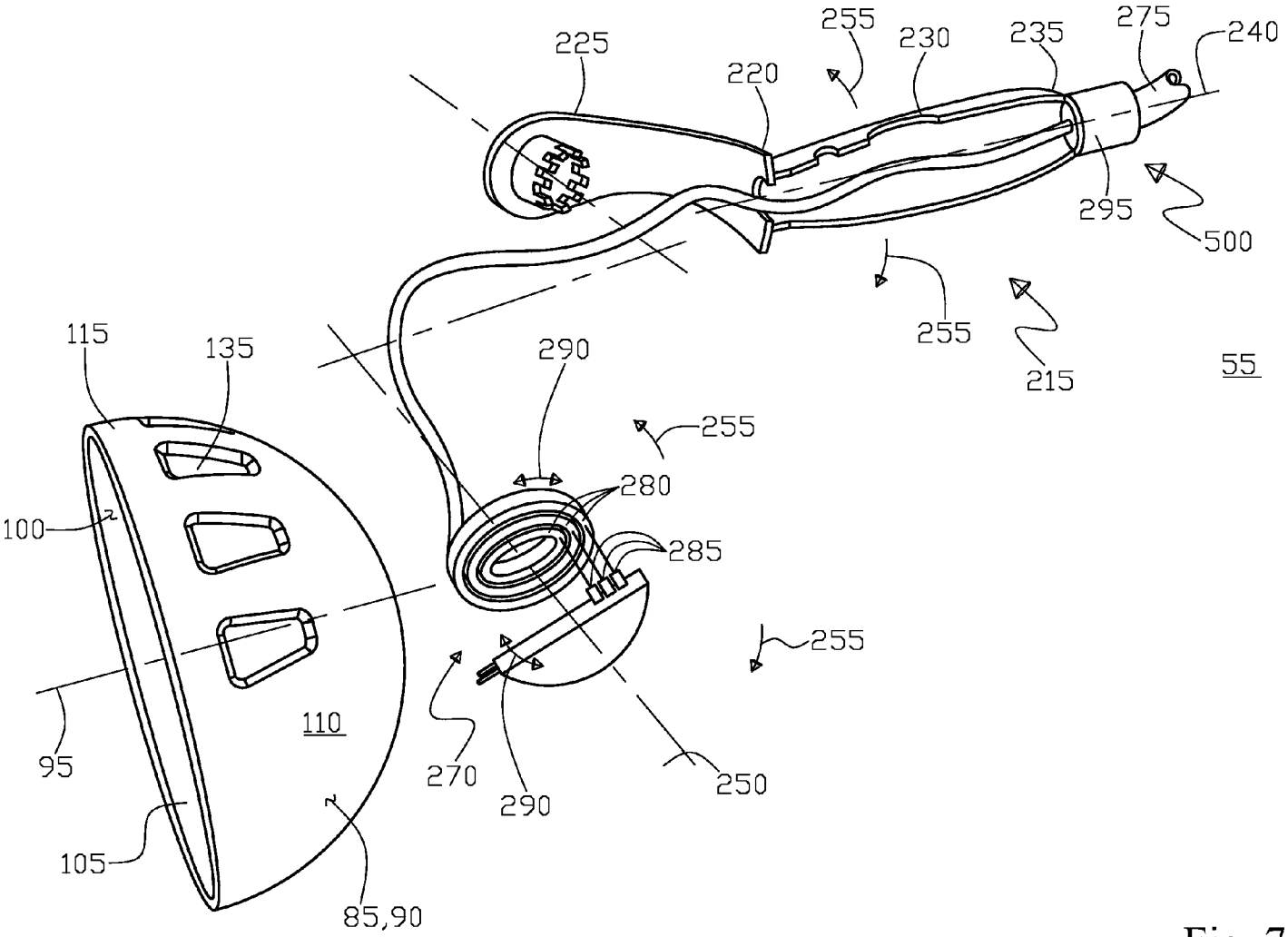
FIG. 7 shows an expanded perspective view of the handle pivotal attachment to the inlet portion of the surrounding sidewall that includes the corded electrical power communication with the electrical communication rotatable couple having the electrically conductive concentric slip rings that are slidably engaged to the electrically conductive fingers to facilitate electrical power communication therethrough the pivotal connection; (stopnochange)

Next, FIG. 7 shows an expanded perspective view of the handle 215 pivotal attachment 245 to the inlet portion 115 of the surrounding sidewall 90 that includes the corded electrical power communication 275 with the electrical communication rotatable couple 270 having the electrically conductive concentric slip rings 280 that are slidably engaged 290 to the electrically conductive fingers 285 to facilitate electrical power communication therethrough the pivotal connection 245.

Figure 8:
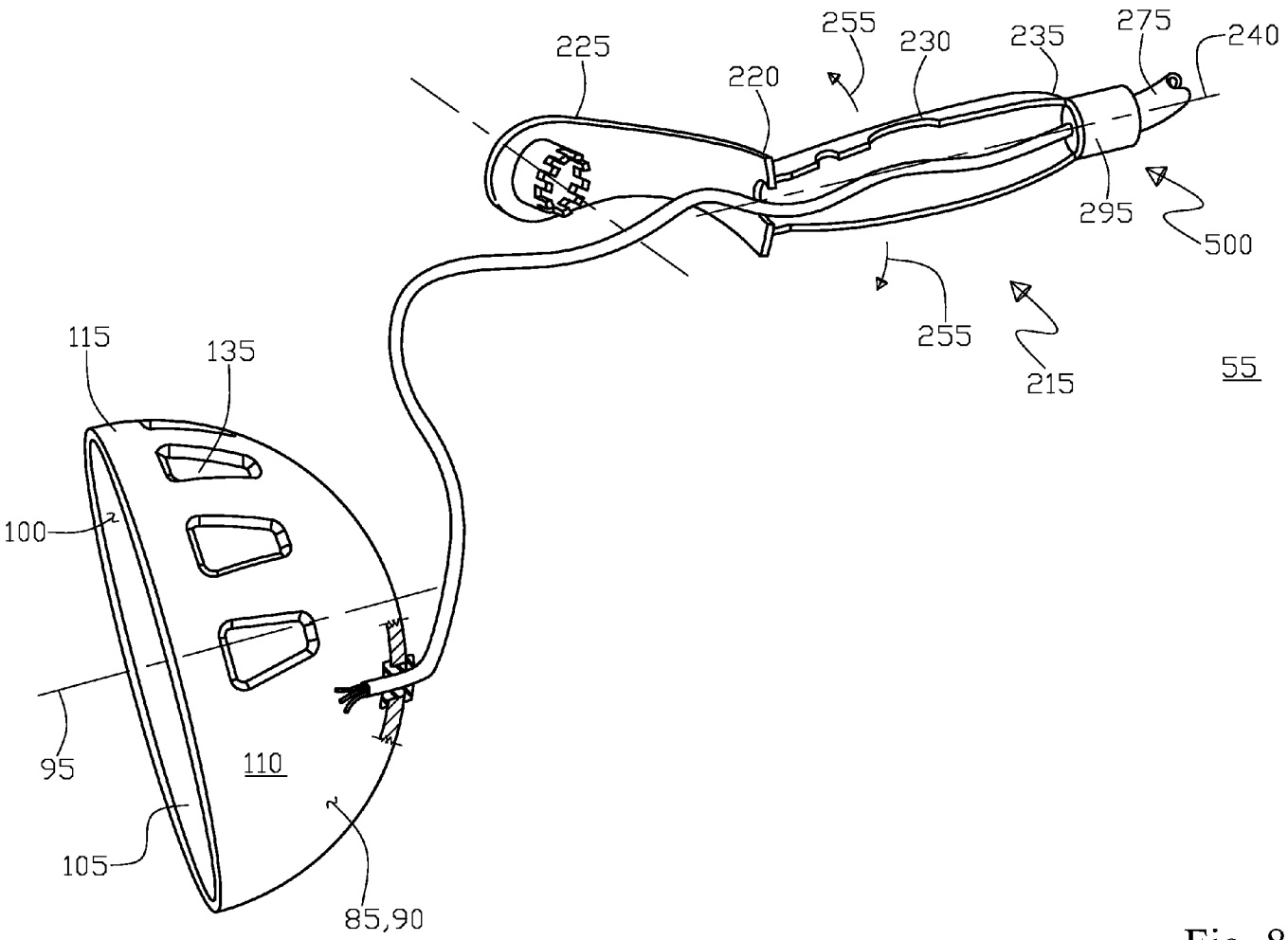
FIG. 8 shows an expanded perspective view of the handle pivotal attachment similar to FIG. 7 being to the inlet portion of the surrounding sidewall that includes the corded electrical power communication alternatively feed therethrough the pivotal connection.
Figure 9:
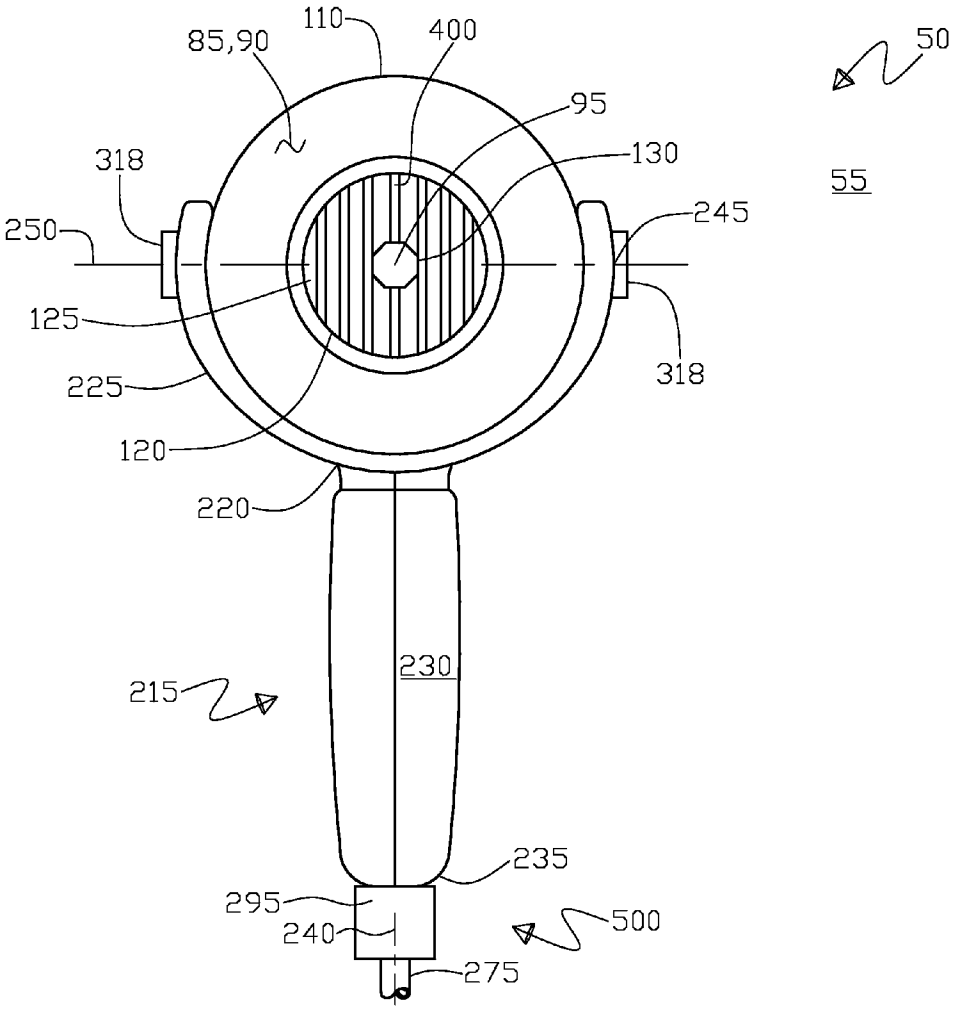
FIG. 9 is an end elevation view of the outlet end of the surrounding sidewall that includes the outlet margin with the grill structure to accommodate removable engagement of the brush with the handle in the perpendicular position of the longwise axis and the longitudinal axis.

Continuing, FIG. 8 shows an expanded perspective view of the handle 215 pivotal attachment 245 similar to FIG. 7 being to the inlet portion 115 of the surrounding sidewall 90 that includes the corded electrical power communication 275 alternatively directly feed therethrough the pivotal connection 245. Moving ahead, FIG. 9 is an end elevation view of the outlet end 120 of the surrounding sidewall 90 that includes the outlet margin 125 with the grill structure 400 to accommodate removable engagement of the brush 65 with the handle 215 in the perpendicular position of the longwise axis 240 and the longitudinal axis 95.

Figure 10:
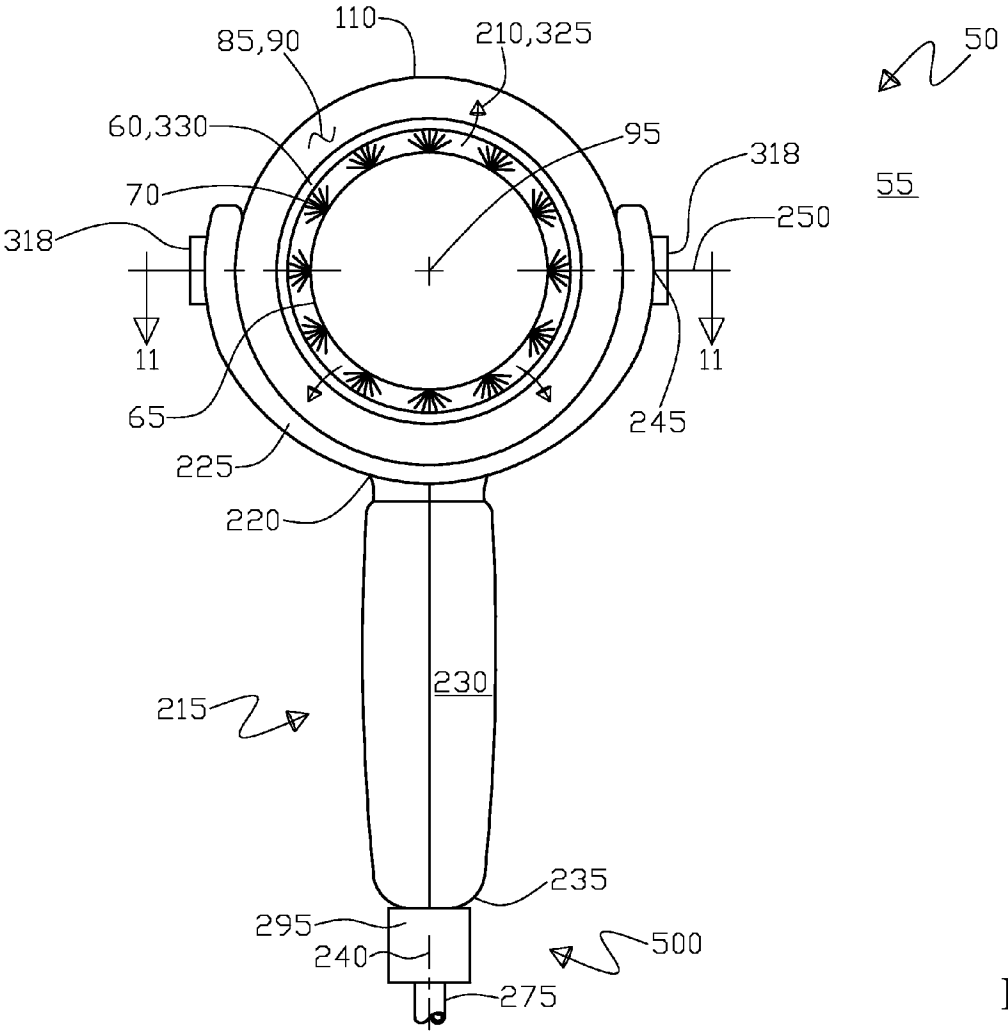
FIG. 10 is an end elevation view of the outlet end of the surrounding sidewall that includes the brush engaged to the structure for removable engagement on the outlet margin of the surrounding sidewall with the handle in the perpendicular position of the longwise axis and the longitudinal axis, wherein the brush bristles and their airflow in relation to the hair is shown.

Further, FIG. 10 is an end elevation view of the outlet end 120 of the surrounding sidewall 90 that includes the brush 65 engaged to the structure 130 for removable engagement on the outlet margin 125 of the surrounding sidewall 90 with the handle 215 in the perpendicular position 265 of the longwise axis 240 and the longitudinal axis 95, wherein the brush 65 bristles 70 and their airflow 210, 325 in relation to the hair 60 is shown.

Figure 11:
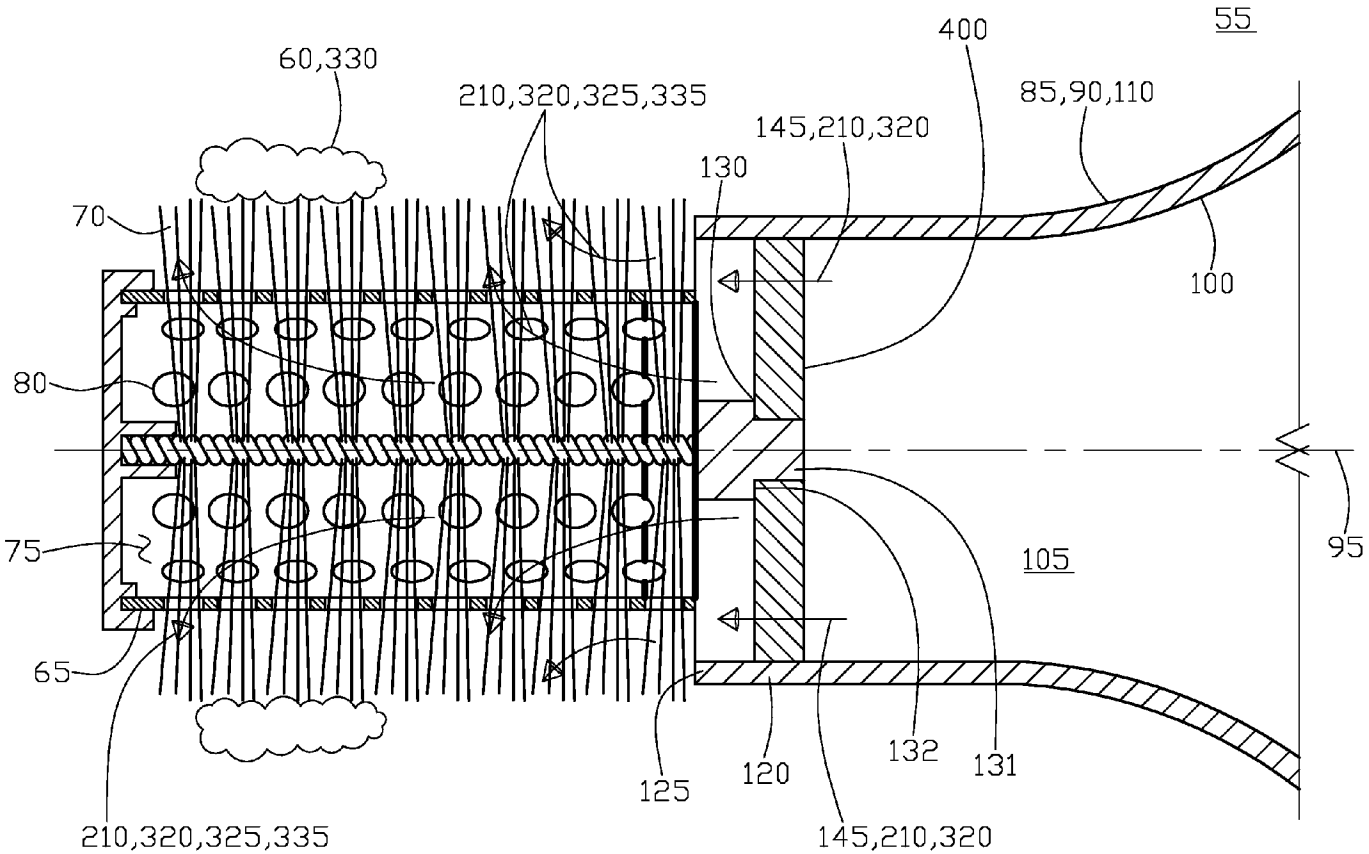

Next, FIG. 11 shows cross section cut 11-11 from FIG. 10, wherein FIG. 11 shows the outlet end portion 120 of the surrounding sidewall 90 that includes the brush 65 engaged to the grille 400 structure 130 for removable engagement on the outlet margin 125 of the surrounding sidewall 90 that shows in particular the brush 65 bristles 70, the brush interior void 75, the radial openings 80 in the brush 65, and the airflow 210, 325 in relation to the bristles 70, radial opening 80, and hair 60 is shown.

Figure 12:
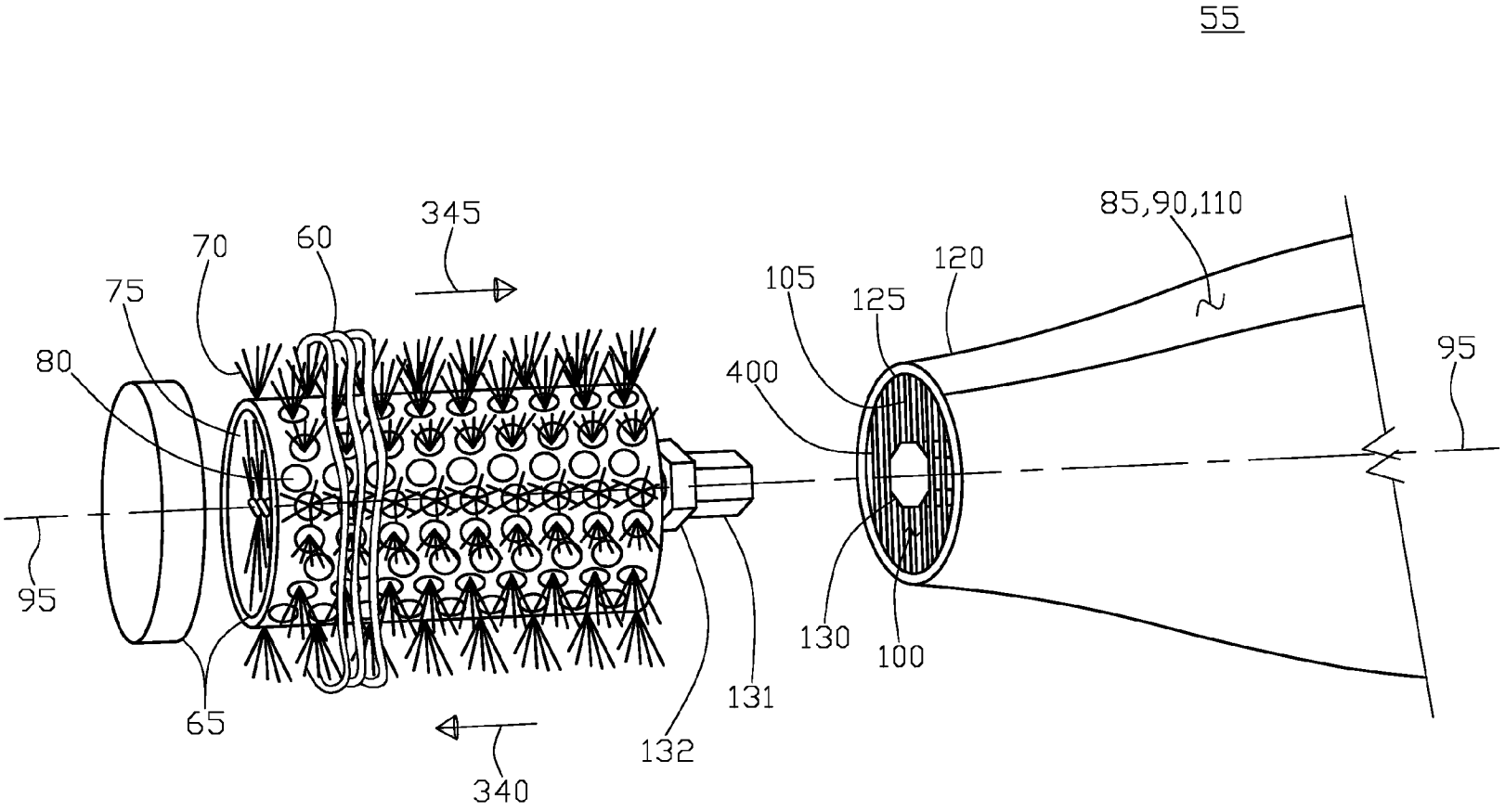

Continuing, FIG. 12 shows an exploded perspective view of FIG. 11, wherein FIG. 12 shows the outlet end portion 120 of the surrounding sidewall 90 that includes the brush 65 dis-engaged to the grille 400 structure 130 for removable engagement adjacent to the outlet margin 125 of the surrounding sidewall 90 that shows in particular the brush 65 bristles 70, the hair 60 wrapped 330 around the brush 65 bristles 70, the brush 65 interior void 75, the radial openings 80 in the brush 65, and the removing 340 engaging 345 the brush 65 to the outlet margin 125 structure 130 via the hex protrusion 131, the hex receptacle 130, and the retaining magnetic shoulder 132 for removable engagement of the brush 65 to the grille 400.

Figure 13:
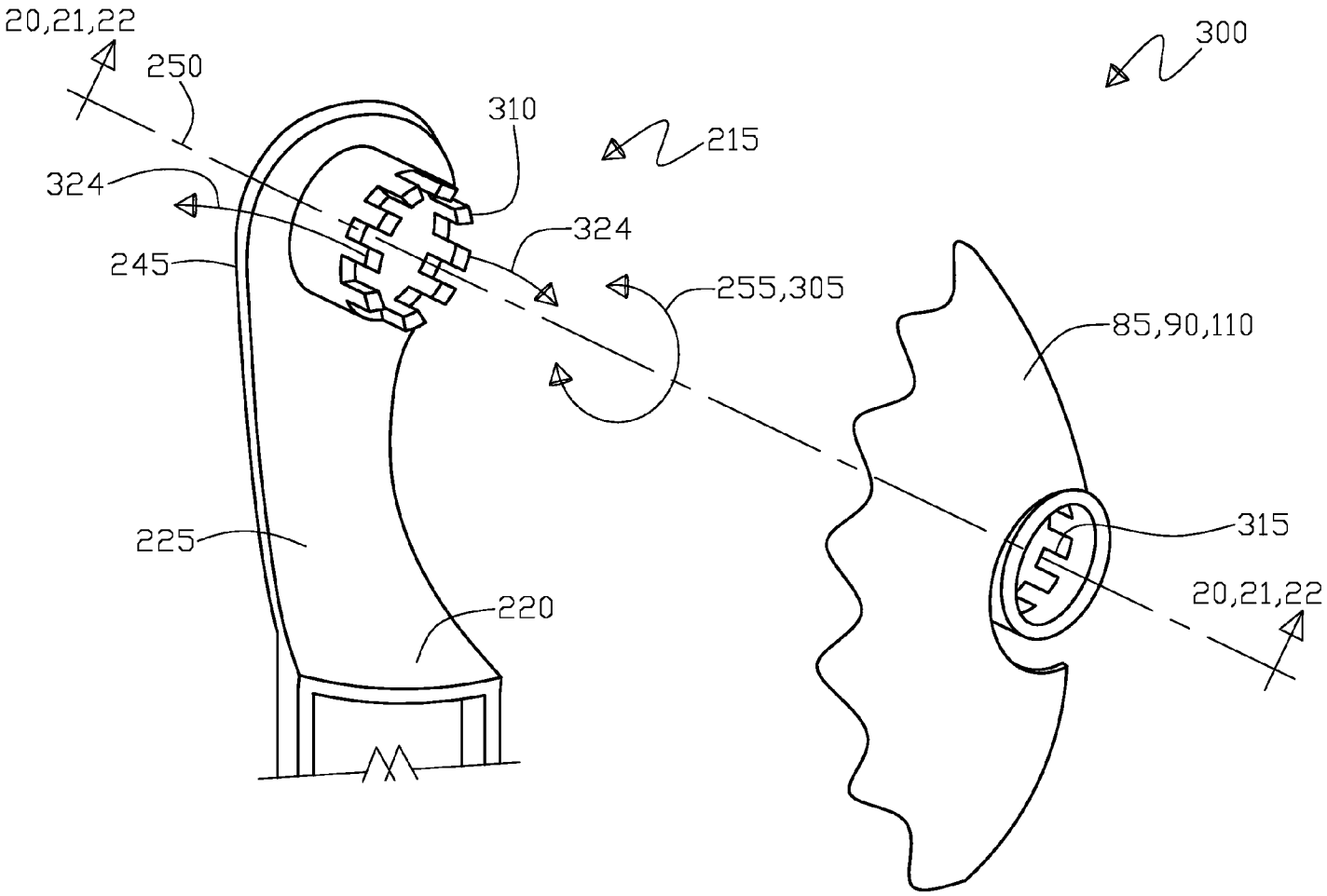
FIG. 13 shows an exploded perspective view of the pivotal connection of the arcuate extension of the clevis shape of the handle that is about the pivotal axis that includes the means for locking the pivotal movement that includes a plurality of recesses and mating plurality of protrusions.

Next, FIG. 13 shows an exploded perspective view of the pivotal connection 245 the arcuate extension 225 of the clevis shape 220 of the handle 215 that is about the pivotal axis 250 that includes the means 300 for locking the pivotal movement 255 that includes a plurality of teeth 310 and mating plurality of teeth.

Figure 14:
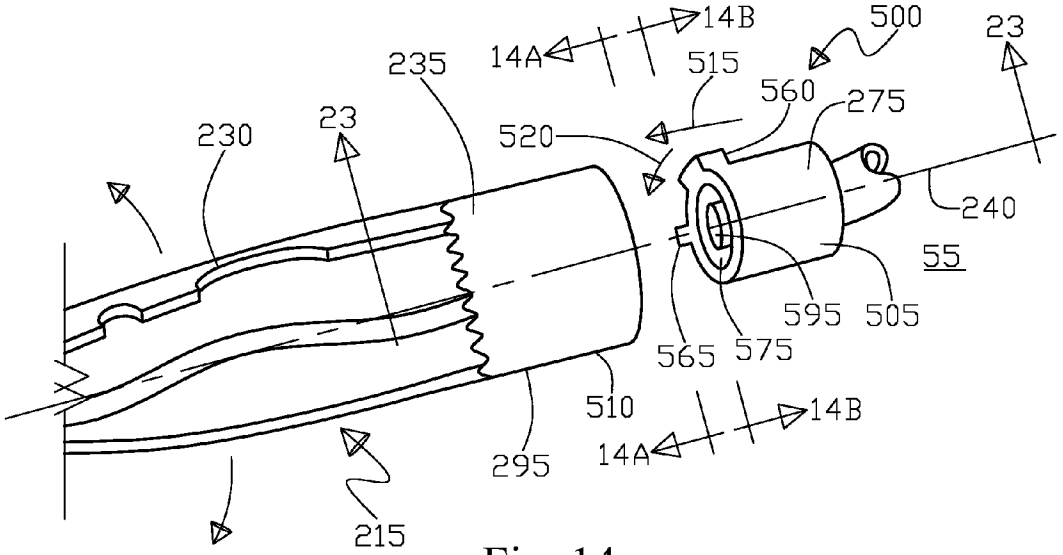
FIG. 14 shows a perspective view of the twist lock plug assembly with the male and female elements separated wherein the twist lock plug assembly facilitates electrical communication as between the male and female elements when the male element is inserted and partially turned to lock the male and female elements together, further the male and female element can be disassembled via reversing the partial turn and separating the male and female elements, noting that without the partial locking turn there will not be electrical communication as between the male and female elements.

Moving onward, FIG. 14 shows a perspective view of the twist lock plug assembly 500 with the male 505 and female 510 elements separated wherein the twist lock plug assembly 500 facilitates removably engagable electrical communication 295 as between the male 505 and female 510 elements when the male element 505 is inserted 515 and partially turned 520 to lock the male 505 and female 510 elements together. Further in FIG. 14, the male 505 and female 510 elements can be disassembled via reversing the partial turn 520 and separating the male 505 and female 510 elements, noting that without the partial locking turn 520 there will not be electrical communication 295 as between the male 505 and female 510 elements as the turn 520 facilitates the electrical contacts 540, 545, 550 to have mating respective electrical communications 295 with contacts 580, 585, 590.

Figure 14B:
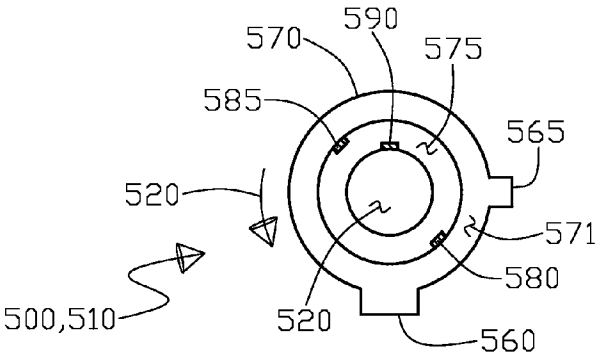
FIG. 14B is view 14B-14B as taken from FIG. 14 showing the male element with a wide protrusion and a narrow protrusion, a male annular cavity that has a primary conductor contact and an oppositely disposed secondary conductor contact, wherein the primary contact is in electrical communication with the first conductor contact and the secondary conductor contact is in electrical communication with the second conductor contact, plus a male cylinder that has a tertiary conductor contact disposed on the outer surface of the cylinder, wherein the tertiary conductor contact is in electrical communication with the third conductor contact, all the aforementioned electrical communications require the male outside diameter to be received into the female annular cavity wherein the male cylinder inserts into the female inner bore while simultaneously matching the wide protrusion to the wide channel and the narrow protrusion to the narrow channel and finally turning the male element in the female element to axially lock the male and female elements to one another thus enabling the aforementioned three electrical communications.
Figure 14A:
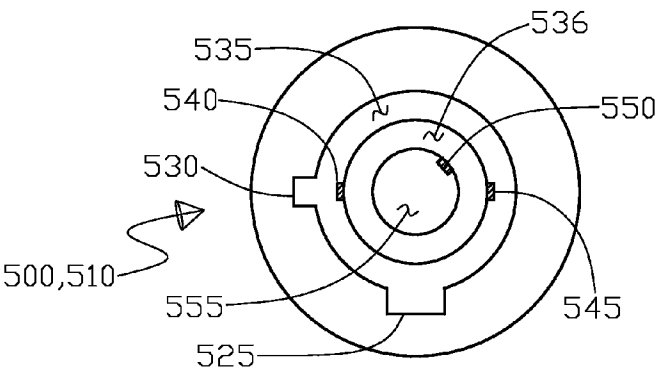
FIG. 14A is view 14A-14A as taken from FIG. 14 showing the female element with a wide channel and a narrow channel, a female annular cavity that has a first and second conductor contact oppositely disposed on the outside diameter of the annular cavity, plus an inner bore with a third conductor disposed on the bore cylindrical surface.

Continuing, FIG. 14A is view 14A-14A as taken from FIG. 14 showing the female element 510 with a wide channel 525 and a narrow channel 530, a female annular cavity 535 that has a first 540 and second 545 conductor contact oppositely disposed on the outside diameter of the annular cavity 535, plus an inner bore 585 with a third conductor 550 disposed on the bore 585 cylindrical surface.

Next, FIG. 14B is view 14B-14B as taken from FIG. 14 showing the male element 505 with a wide protrusion 560 and a narrow protrusion 565, a male annular cavity 575 that has a primary conductor contact 580 and an oppositely disposed secondary conductor contact 585, wherein the primary contact 580 is in electrical communication with the first conductor contact 540 and the secondary conductor contact 585 is in electrical communication with the second conductor contact 545, plus a male cylinder 595 that has a tertiary conductor contact 590 disposed on the outer surface of the cylinder 595, wherein the tertiary conductor contact 590 is in electrical communication with the third conductor contact 550. Wherein FIGS. 14, 14A, and 14B show that all the aforementioned electrical communications 295 require the male 505 outside diameter 570 to be received into the female 510 annular cavity 535 wherein the male 505 inserts 515 into the female 510 inner bore 555 while simultaneously matching the wide protrusion 560 to the wide channel 525 and the narrow protrusion 565 to the narrow channel 530 and finally turning 520 the male element 505 in the female element 510 to axially lock the male 505 and female 510 elements to one another thus enabling the aforementioned three electrical communications 295.

Figure 15:
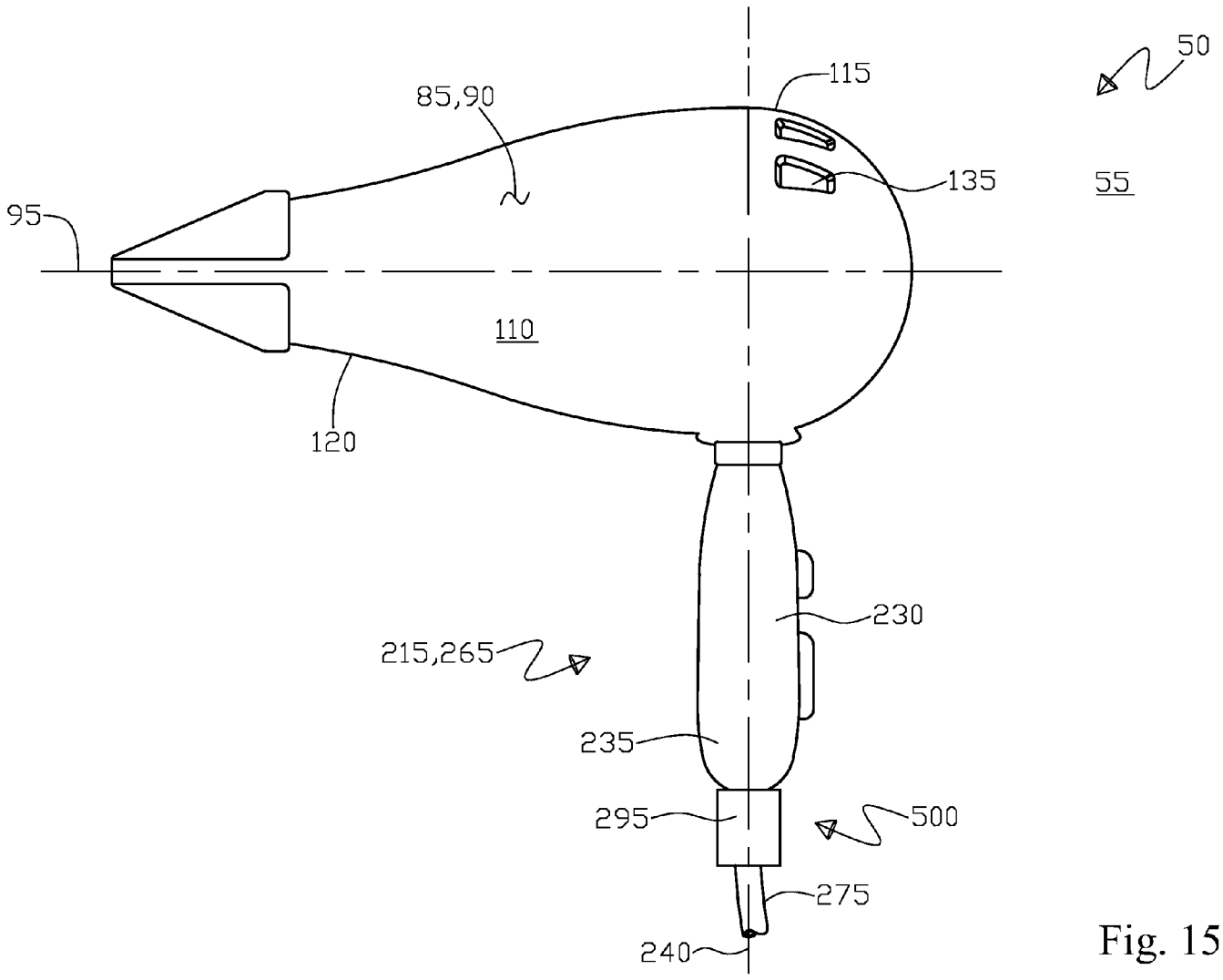
FIG. 15 shows a side elevation view of the hair dryer apparatus that includes the housing, the handle that is in the perpendicular fixed position of the longwise axis and the longitudinal axis, the inlet and outlet portions of the surrounding sidewall, and the structure for removable engagement of the electrical power communication.

Continuing, FIG. 15 shows a side elevation view of the hair dryer apparatus 50 that includes the housing 85, the handle 215 that is in the perpendicular fixed position 265 of the longwise axis 240 and the longitudinal axis 95, the inlet 115 and outlet 120 portions of the surrounding sidewall 90, and the structure for removable engagement 295 the electrical power communication.

Figure 16:
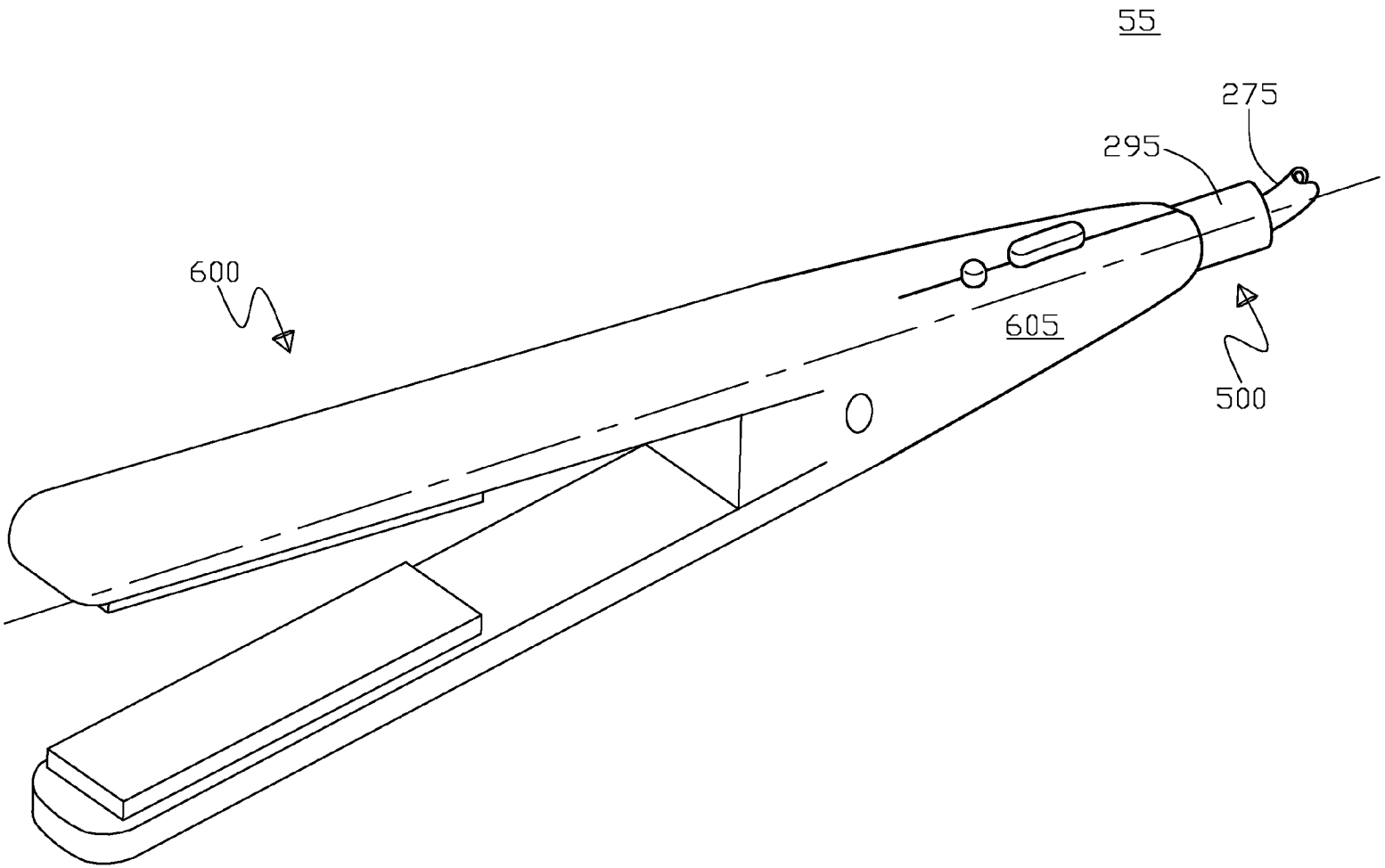
FIG. 16 shows a flat iron with a handle that uses the twist and lock removably engagable electrical plug assembly.
Figure 17:
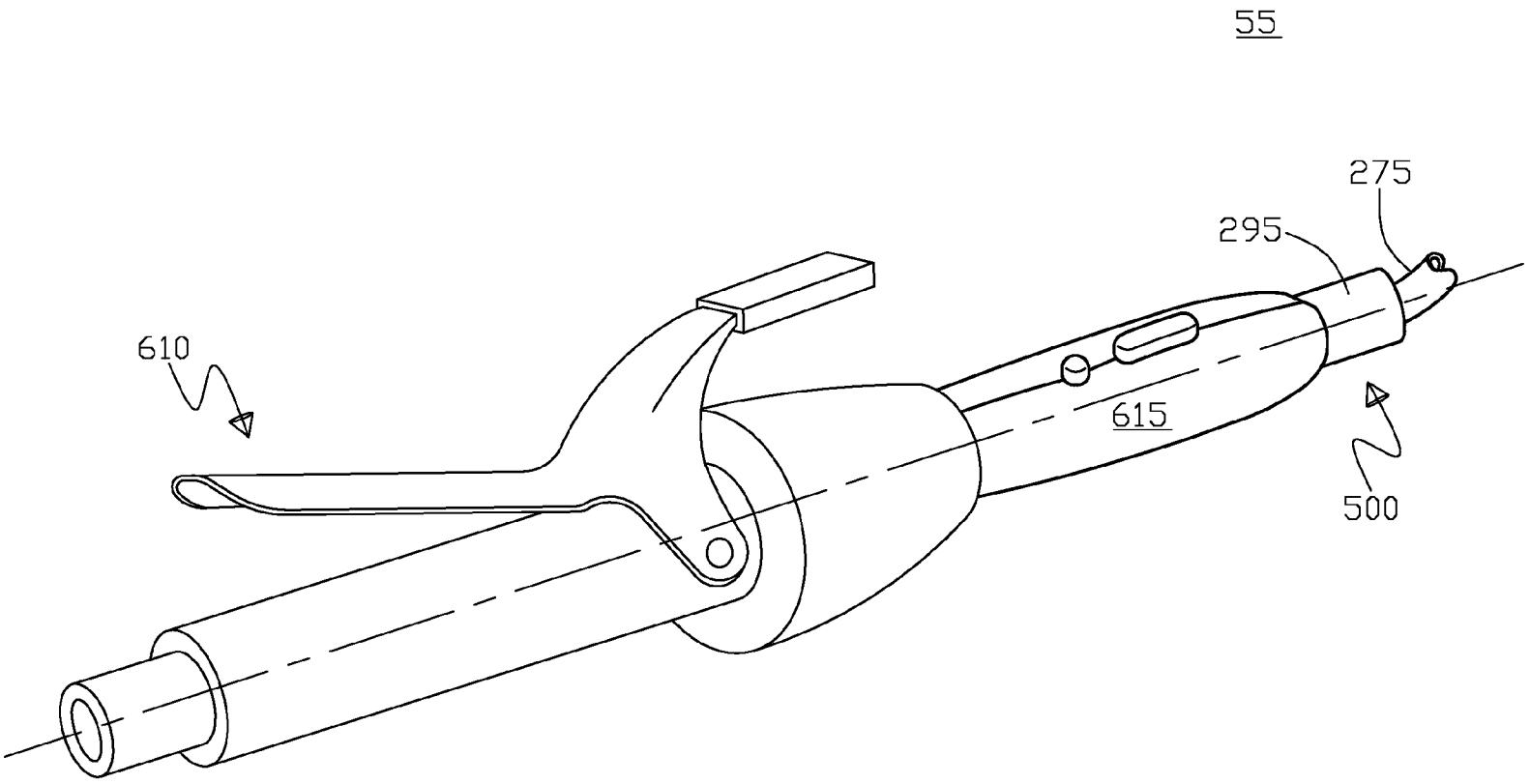
FIG. 17 shows a curling iron with a handle that uses the twist and lock removably engagable electrical plug assembly.
Figure 18:
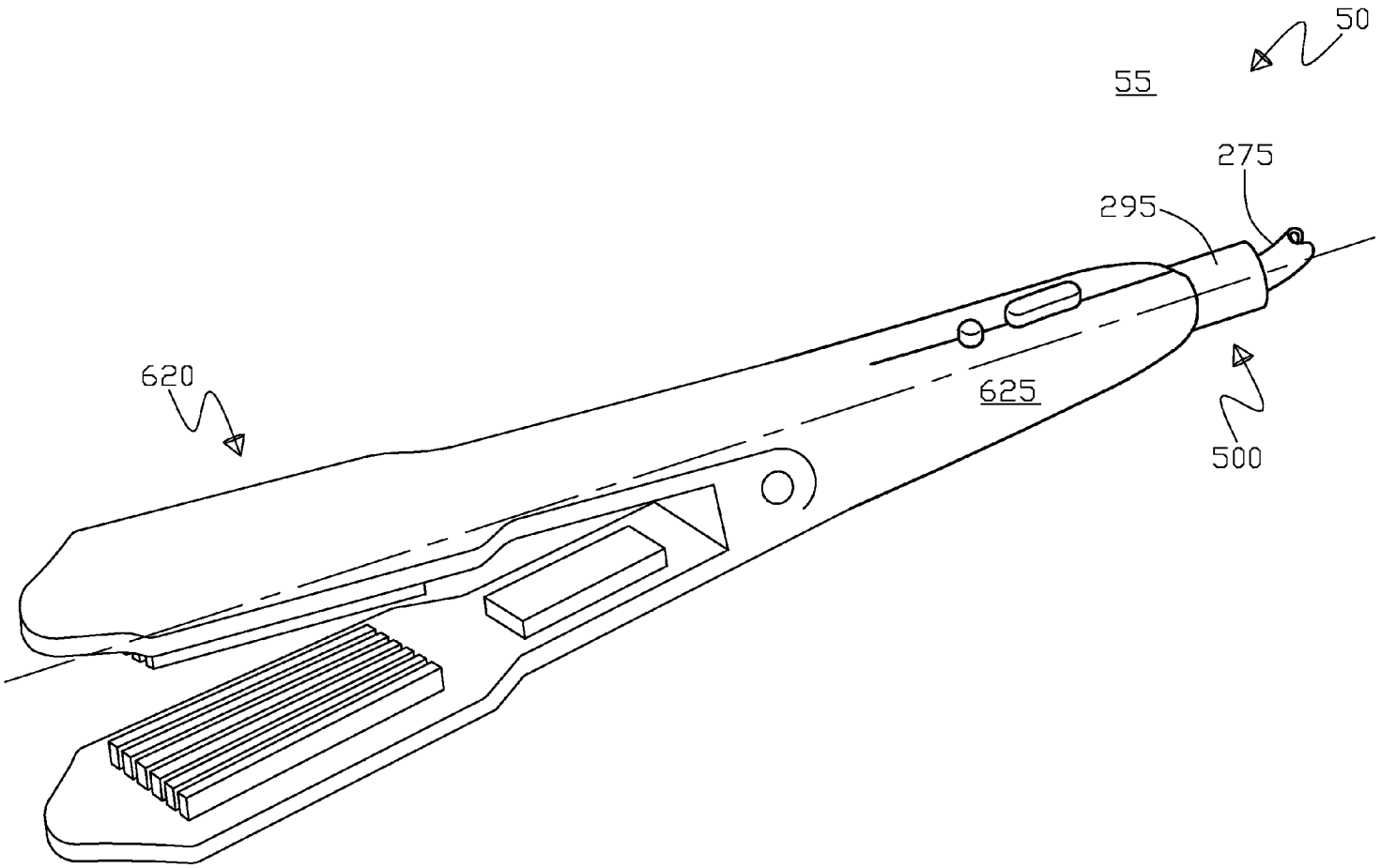
FIG. 18 shows a crimping iron with a handle that uses the twist and lock removably engagable electrical plug assembly.
Figure 19:
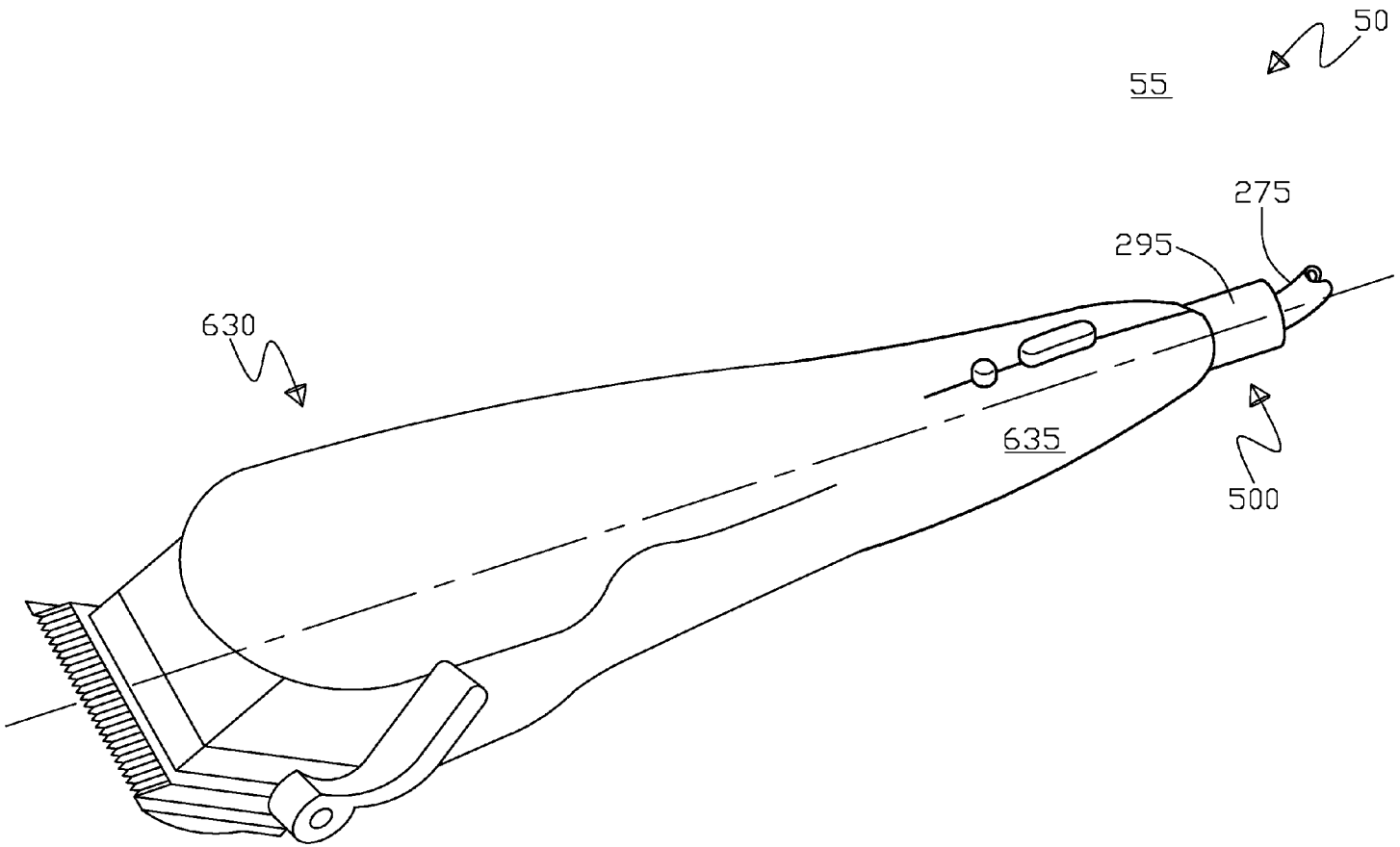
FIG. 19 shows a clipper with a handle that uses the twist and lock removably engagable electrical plug assembly.

Next, FIG. 16 shows a flat iron 600 with a handle 605 that uses the twist and lock removably engagable electrical plug assembly 500. Continuing, FIG. 17 shows a curling iron 610 with a handle 615 that uses the twist and lock removably engagable electrical plug assembly 500. Further, FIG. 18 shows a crimping iron 620 with a handle 625 that uses the twist and lock removably engagable electrical plug assembly 500. Continuing, FIG. 19 shows a clipper 630 with a handle 635 that uses the twist and lock removably engagable electrical plug assembly 500.

Figure 20:
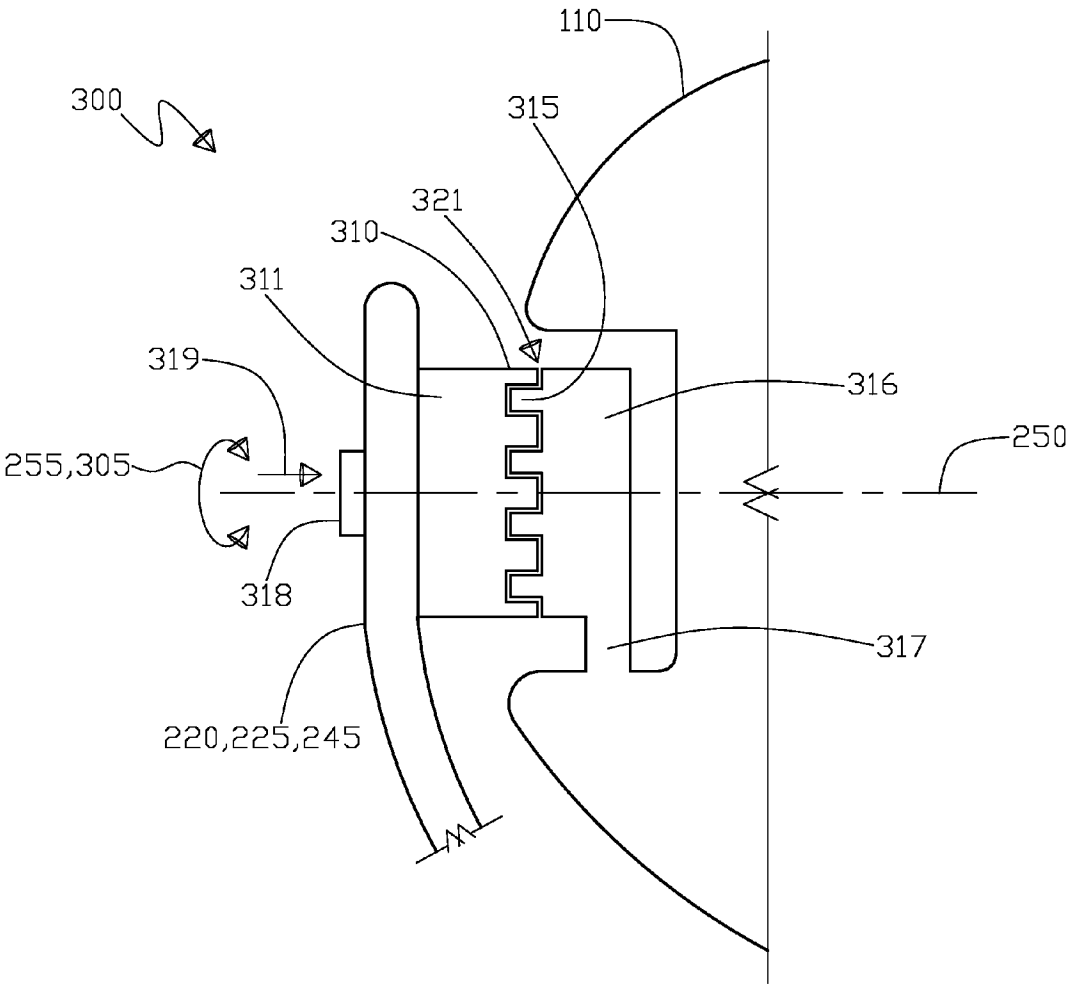
FIG. 20 shows a side elevation view of the means for locking pivotal movement as between the clevis and the outer surface that is in the closed or locked and engaged state to as between the clevis and the outer surface to prevent pivotal movement as between the clevis and the outer surface.

Moving ahead, FIG. 20 shows a side elevation view of the means 300 for locking pivotal movement 255 as between the clevis 220 and the outer surface 110 that is in the closed or locked and engaged state 321 to as between the clevis 220 and the outer surface 110 to prevent pivotal movement 255 as between the clevis 220 and the outer surface 110.

Figure 21:
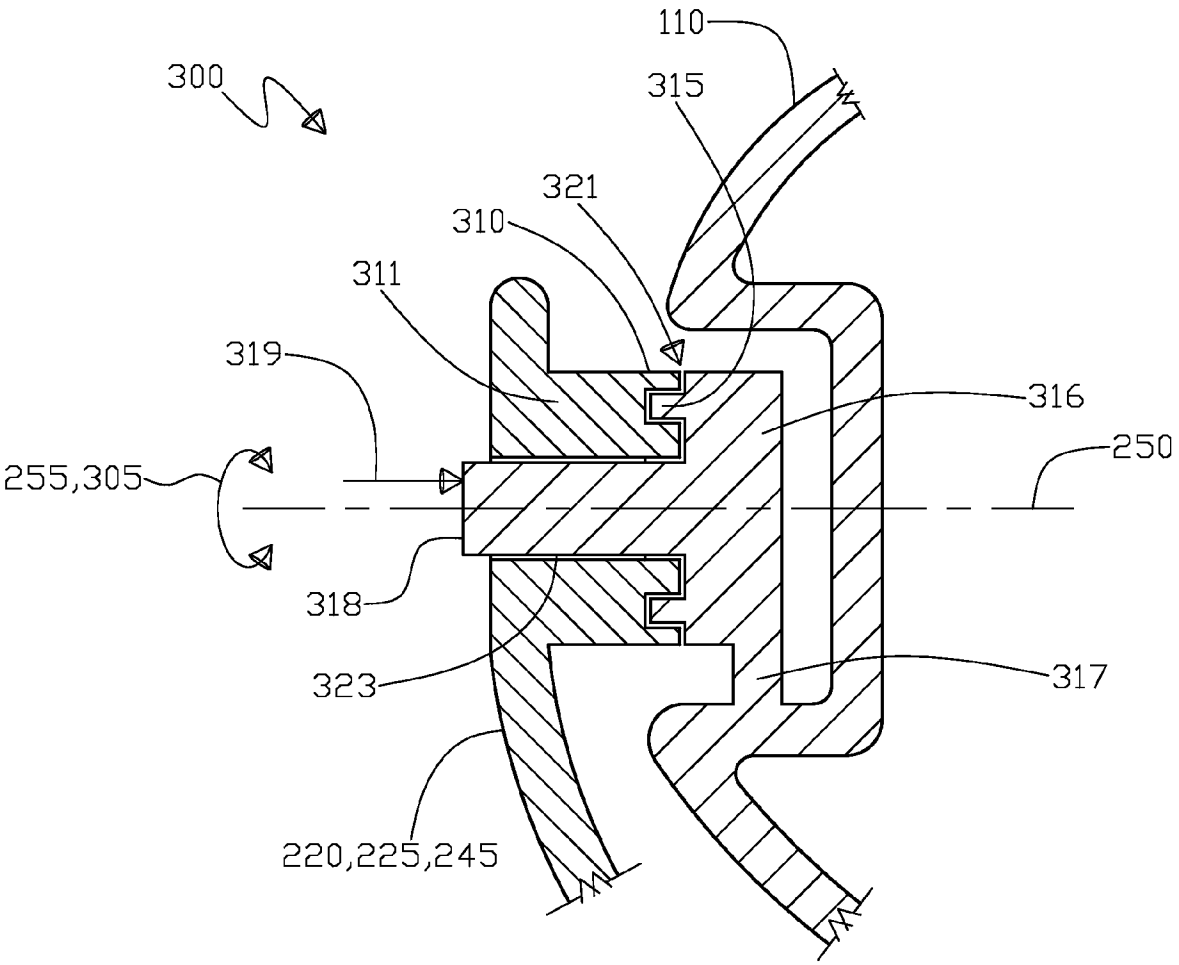
FIG. 21 shows a side elevation cross sectional view of FIG. 20, with FIG. 21 showing the means for locking pivotal movement as between the clevis and the outer surface that is in the closed or locked and engaged state to as between the clevis and the outer surface to prevent pivotal movement as between the clevis and the outer surface.

Next, FIG. 21 shows a side elevation cross sectional view of FIG. 20, with FIG. 21 showing the means 300 for locking pivotal movement 255 as between the clevis 220 and the outer surface 110 that is in the closed or locked and engaged state 321 to as between the clevis 220 and the outer surface 110 to prevent pivotal movement 255 as between the clevis 220 and the outer surface 110.

Figure 22:
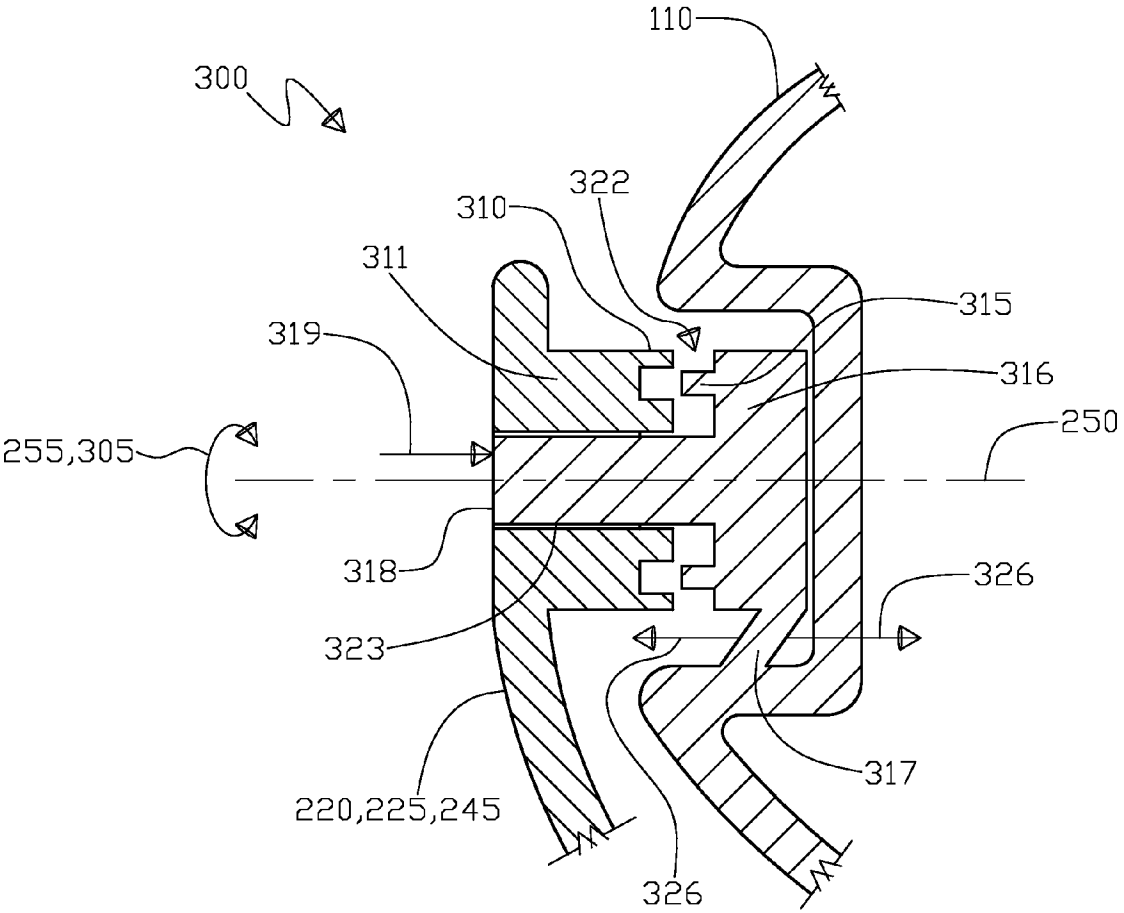
FIG. 22 shows a side elevation cross sectional view of FIG. 20, with FIG. 22 modified to show the means for locking pivotal movement as between the clevis and the outer surface that is in the open or unlocked and disengaged state to as between the clevis and the outer surface to allow pivotal movement as between the clevis and the outer surface.

Further, FIG. 22 shows a side elevation cross sectional view of FIG. 20, with FIG. 22 modified to show the means 300 for locking pivotal movement 255 as between the clevis 220 and the outer surface 110 that is in the open or unlocked and disengaged state 322 to as between the clevis 220 and the outer surface 110 to allow pivotal movement 255 as between the clevis 220 and the outer surface 110.

Figure 23:
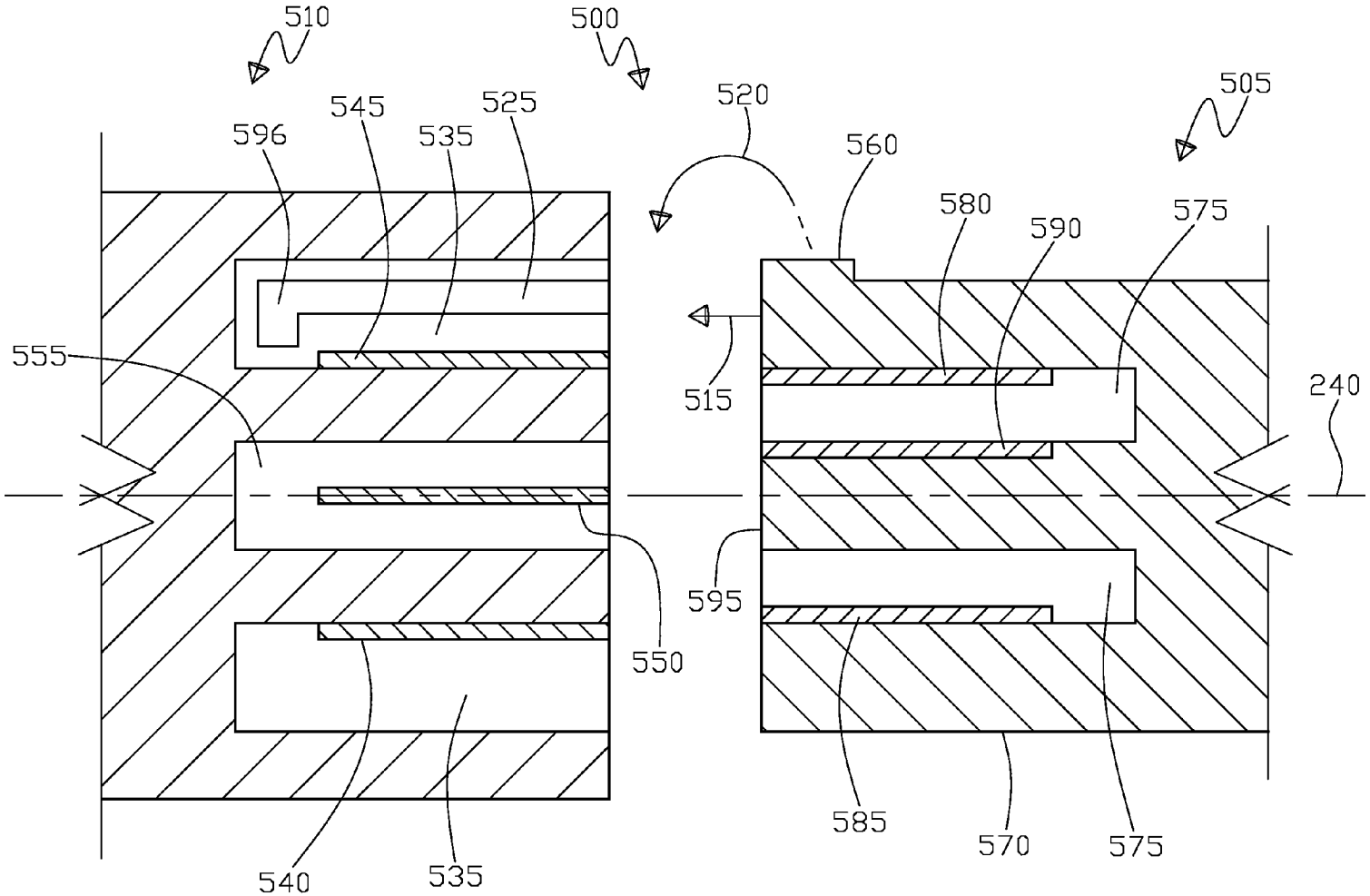
FIG. 23 shows cross sectional view 23-23 from FIG. 14 of the twist lock removably engagable electrical plug assembly that details in cross section what

Continuing, FIG. 23 shows cross sectional view 23-23 from FIG. 14 of the twist lock removably engagable electrical plug assembly 500 that details in cross section what FIGS. 14A and 14B show from an end view, also showing the "L" shaped twist lock 596 that is used for both the wide 525 and narrow 530 that receives the wide 560 and narrow 565 protrusions via the turn movement 520 to effectuate the locking axially of the male 505 and female 510 elements to one another while at the same time allowing electrical communication 295 as between the primary contact 580 and the first conductor contact 540 plus the secondary conductor contact 585 is in electrical communication 295 with the second conductor contact 545, and the tertiary conductor contact 590 is in electrical communication 295 with the third conductor contact 550.

Broadly, in looking at FIGS. 1 to 23, the present invention is a hair dryer apparatus 50 that includes the housing 85 with the surrounding sidewall 90 that is about a longitudinal axis 95, the surrounding sidewall 90 having an inner surface portion 100 defining the sidewall interior 105 and the surrounding sidewall 90 having an opposing outer surface portion 110, further the surrounding sidewall 90 having an inlet portion 115 and an opposing outlet portion 120 with the longitudinal axis 95 spanning therebetween, as best shown in FIGS. 1 to 13, 15, and 20 to 22.

Optionally, for the housing 85, the inlet portion 115 can further have a radial mouth opening 135 from the outer surface portion 110 therethrough to the inner surface portion 100 allowing fluid communication 145 from an external environment 55 to the sidewall interior 105, the mouth opening 135 is about a mouth axis 140 that is positioned substantially perpendicular to the longitudinal axis 95, to operationally have the airflow 210 at the inlet portion 115 directed away from the handle 215 and the user grasping the handle 215 that are typically directly behind or in-line with the longitudinal axis 95, see FIG. 5 in particular and FIGS. 1 to 4.

In addition, the hair dryer apparatus 50 includes the motor 190 driven blower 195 disposed within the surrounding sidewall 90 interior 105, the blower 195 being operational to drive airflow 210 from the inlet portion 115 therethrough the sidewall interior 105 to the outlet portion 120, see in particular FIG. 5, plus also FIGS. 9 and 10.

As an optional enhancement to the inlet portion 115 in conjunction with the radial mouth opening 135 and mouth axis 140 as previously described, an annular baffle 150 can be added that is positioned about the longitudinal axis 95 and disposed within the sidewall interior 105 adjacent to the opening 135, see in particular FIG. 5. The annular baffle 150 is sized and configured to transition the airflow 145, 170, 210 that is parallel to the mouth axis 140 to be parallel to the longitudinal axis 95 prior to feeding the airflow 145, 175, 185 210 to the blower 195, again see FIG. 5 in particular. Wherein operationally, this allows the mouth 135 to be positioned away from the user and adds a sound abatement barrier 180 as between the mouth 135 and the blower 195, again see FIG. 5 in particular. Additionally, on the optional annular baffle 150, the annular baffle 150 can have an outer periphery 155 that is affixed to the sidewall 90 inner surface portion 100 thus creating an inlet chamber 165 that is in fluid communication 170 with the external environment 55 and the mouth 135; again see FIG. 5 in particular. The annular baffle 150 can also have an inner opening 160 from the inlet chamber 165 to direct the airflow 145, 175, 185, 210 to a central portion 200 of the blower 195 to minimize a suction noise of the blower 195 via covering an outer portion 205 of the blower 195 that has a higher operational tip speed and more noise thus helping in the sound abatement 180, again see FIG. 5 in particular.

Further included in the hair dryer apparatus 50 is a handle 215 in the form of the clevis shape 220 with the clevis shape 220 having the pair of symmetrically opposed arcuate extensions 225 that have a common origination from the handle stem extension portion 230, see FIGS. 1 to 4, plus FIGS. 6 to 10. Wherein, the stem extension portion 230 has an opposing free end portion 235, also each of the arcuate extensions 225 terminate in a pivotal connection 245 to the sidewall outer surface portion 110 of the inlet portion 115, wherein the pivotal connections 245 are along a common pivotal axis 250, see in particular FIGS. 1 to 4, plus FIGS. 6 to 10, 13, and FIGS. 20 to 22. Wherein operationally, the handle 215 stem extension portion 230 in a longwise manner along a longwise axis 240 has a pivotal movement range 255 from being co-axial 260 to the longitudinal axis 95 to being substantially perpendicular 265 to the longitudinal axis 95, as best shown in FIGS. 1 to 4.

Alternatively, the hair dryer apparatus 50 can further comprise an electrical communication rotatable couple 270 that is disposed at the pivotal connection 245 that facilitates the corded electrical power communication 275 for the motor 190 to exit from the free end portion 235 of the stem extension 230, see in particular FIG. 7, plus FIGS. 1 to 4. Further, for the electrical communication rotatable couple 20 is preferably constructed of the plurality of electrically conductive concentric slip rings 280 that are positioned about the pivotal axis 250, wherein the slip rings 280 are one on one slidably 290 in contact with the plurality of corresponding electrically conductive fingers 285, again see in particular FIG. 7. Wherein operationally, the fingers 285 slide 290 as against the slip rings 280 on a one on one electrically communicative arrangement wherein the adjacent fingers 285 and the adjacent rings 280 are insulated from one another, thus the sliding 290 engagement being in accordance with the pivotal movement 255 to allow electrical communication across the pivotal connection 245 during the pivotal movement 255 and when the handle 215 is static in relation to the housing 85, again see FIG. 7 and FIGS. 1 to 4.

Optionally, as an enhancement for the hair dryer apparatus 50 the pivotal connection 245 can preferably further comprises the means 300 for locking the pivotal movement 255 of the handle 215 to the housing 85 in a plurality of selectable positions 305 within the pivotal movement range 255, see FIG. 13, plus FIGS. 1 to 4, and FIGS. 20 to 22. Further on the means 300 for locking the pivotal movement 255 is preferably constructed of a plurality of teeth 310 disposed upon the rotational engagement 311 of the clevis 220 and mating teeth 315 disposed on the rotational engagement 36 of the surrounding sidewall 90 outer surface portion 110, wherein the plurality of teeth 310 removably engage a matching plurality of teeth 315, see in particular FIG. 13, plus FIGS. 1 to 4, and FIGS. 7 and 8, in addition to FIGS. 20 to 22.

As an additional option for the hair dryer apparatus 50 the sidewall outlet portion 120 can terminate in the outlet margin 125 wherein the outlet margin 125 further can have structure 130 preferably in the form of the hex receptacle to accommodate the hex protrusion 131 with shoulder magnet 132 forming the removable engagement of the brush 65 to the outlet margin 125, wherein the brush 65 has external bristles 70 and an interior void 75 that is in fluid communication 145, 210, 320 with the sidewall 90 interior 105, the brush 65 has the plurality of radial openings 80 in relation to the longitudinal axis 95 that allow fluid communication 210, 320, 325 from the void 75 to the bristles 70, see FIGS. 9 to 12. Further, alternatively for the brush 65 removable engagement structure 130 is also preferably of a hex design to help prevent rotation of the brush 65 about the longitudinal axis 95 relative to the housing 85, see in particular FIG. 11, for the operational purpose of holding the hair 60 about the bristles 70 which grasping the handle 215, see FIGS. 10 and 11. Wherein operationally, the airflow 210, 320, 325 from the blower 195 can exit therethrough the openings 80 to have the airflow 325 at the bristles 70, again see FIGS. 10 to 12.

Another option for the hair dryer apparatus 50 can further comprise a removably engagable structure 295 for the electrical power communication 275, wherein the removably engagable structure 295 is disposed within the stem 230 free end portion 235 to operationally allow for the corded electrical power communication 275 to be removably engagable to the stem 230 extension portion free end portion 235 in the external environment 55, as best shown in FIGS. 14, 14A, 14B, and 23, however, also shown in FIGS. 1 to 4, and FIGS. 6 to 8, and 15 to 19. The removably engagable structure 295 is preferably a twist lock type 500 as previously described.

Referring in particular to FIGS. 20 to 22, plus FIGS. 1 to 4, 6 to 10, and 13 the pivotal connection 245 means 300 preferably includes a plurality of removably engagable teeth 310 disposed on a rotational engagement 311 of the clevis 220 and a mating plurality of removably engagable teeth 315 disposed on a rotational engagement 316 of the outer surface 110, the plurality of teeth 310, 315 have the matingly engaged state 321, see FIGS. 20 and 21, and the disengaged state 322, see FIG. 22, via movement along the pivotal axis 250 facilitated by the flexible link 317 disposed between the outer surface 110 and the rotational engagement 316 of the outer surface. Wherein the pivotal connections 245 are along the pivotal axis 250, further, operationally the handle 215 stem extension portion 230 in a longwise manner along a longwise axis 240 has a pivotal movement 255 range from being co-axial 260 to the longitudinal axis 95 to being substantially perpendicular 265 to the longitudinal axis 95 as the pivotal movement 255 is free when the pivotal connection 245 is in the open state 322 and the pivotal movement 255 is locked when the pivotal connection 245 is in the closed state 321.

Again, referring in particular to FIGS. 20 to 22, plus FIGS. 1 to 4, 6 to 10, and 13, the means 300 further comprising the button 318 that forms a part of the outer surface 110 removable engagement 316, wherein the button 318 extends therethrough the clevis 220 rotational engagement 311 along the pivotal axis 250, wherein the button 318 facilitating the pivotal connection 323 as between the clevis 220 and the outer surface 110 rotational engagement 316, see in particular FIGS. 21 and 22. Wherein operationally, when the button 318 is depressed causing button 318 movement 319 toward the outer surface 100 resulting in moving 326 the outer surface 110 rotational engagement 16 closer to the outer surface 110 via the flexible link 317 which takes the mating plurality of teeth 310, 315 from the closed state 321 to the open state 322 to allow the pivotal movement 255, in going from FIGS. 20 and 21 to FIG. 22. Wherein releasing the button 318 urges a reverse button 318 movement 319 via the flexible link 317 further separating the outer surface rotational engagement 316 from the outer surface 110 placing the plurality of mating teeth 310, 315 into the closed state 321 to lock the pivotal movement 255, essentially going from FIG. 22 to FIGS. 20 and 21.

Looking in particular at FIGS. 9, 11, and 12, for the hair dryer apparatus 50 wherein the brush 65 to outlet margin 125 removable engagement is preferably constructed of the hex receptacle 130 disposed in the outlet margin 125 that receives the hex protrusion 131 on the brush 65, further the hex protrusion 131 includes the magnetic shoulder 132 that magnetically attracts to the outlet margin 125 grille 400 to operationally retain the brush 65 to the outlet margin 125 grille 400 however allowing separation as between the brush 65 and the outlet margin 125 grille 400 via a manual separating pull as between the brush 65 and the outlet margin 125 grille 400 along the longitudinal axis 95.

Looking in particular at FIGS. 14, 14A, 14B, and 23 plus FIGS. 1 to 4, 6 to 10, and 15 to 19, that disclose an electrical appliance comprising a handle 215 having a longwise axis 240 and a free end portion 235 that incorporates the twist locking removably engagable electrical plug assembly 500 disposed on the free end portion 235, the electrical plug assembly 500 includes the female element portion 510 and the male element portion 505. The female element 510 includes the female annular cavity 535 that is disposed about the longwise axis 240, the female inner cylinder 536 about the longwise axis 240 that is disposed inward of the female annular cavity 535, and the female inner bore 555 that is about the longwise axis 240 disposed inward of the female inner cylinder 536.

Further included is a wide channel 525 disposed in the female annular cavity 535 that runs parallel to the longwise axis 240, wherein the wide channel 525 terminates in a "L" shape 596 wherein the wide channel 525 terminates in a section that is perpendicular to the wide channel 525. Also further included in the female element 510 is the narrow channel 530 disposed in the female annular cavity 535 that runs parallel to the longwise axis 240, wherein the narrow channel 530 terminates in a "L" shape 596 wherein the narrow channel 530 terminates in a section that is perpendicular to the narrow channel 530, wherein the wide and narrow "L" shapes 596 face the same circumferential direction 520, further the first conductor contact 540 and a second conductor contact 545 are both disposed in the female annular cavity 535, plus the third conductor contact 550 is disposed in the female inner bore 555.

Also included in the twist lock removably engagable electrical plug assembly 500 is the male element portion 505 that comprises the male outer diameter 570 that forms a male outer cylinder 571 that are both disposed about the longwise axis 240, plus the male annular cavity 575 that is about the longwise axis 240 that is disposed inward of the male outer cylinder 571, and the male cylinder 585 that is about the longwise axis 240 disposed inward of the male annular cavity 575. Further included in the male element 505 is the wide protrusion 560 disposed on the male outer diameter 570, also further included is the narrow protrusion 565 disposed on the male outer diameter 570, further the primary conductor contact 580 is disposed in the male annular cavity 575, also the secondary conductor contact 585 is disposed in the male annular cavity 575, plus the tertiary conductor contact 590 is disposed on the male cylinder 595.

Wherein the wide protrusion 560 is received by the wide channel 525 via movement 515 along the longwise axis 240 and the narrow protrusion 565 is received by the narrow channel 530 via movement 515 along the longwise axis 240 to facilitate a singular positional orientation as between the male 505 and female 510 elements, as the male element 505 is inserted via insertion movement 515 into the female element 510 along the longwise axis 240. Further when the insertion movement 515 bottoms out the male element 505 is then rotationally turned 520 to have the wide 560 and narrow 565 protrusions be respectively received into the wide 525 and narrow 530 "L" shapes 596 to axially lock the male element 505 into the female element 510 along the longwise axis 240.

Wherein operationally, only when the axial lock is in place is there is electrical communication as between the male 505 and female 510 elements, wherein the primary contact 580 is in electrical communication with the first conductor contact 540 and the secondary conductor contact 585 is in electrical communication with the second conductor contact 545, plus the tertiary conductor contact 590 is in electrical communication with the third conductor contact 550. All the aforementioned electrical communications require the male outside diameter 570 to be received into the female annular cavity 535 wherein the male cylinder 595 inserts into the female inner bore 555 while simultaneously matching the wide protrusion 560 to the wide channel 525 and the narrow protrusion 565 to the narrow channel 530 and finally turning 520 the male element 505 in the female element 510 to axially lock the male 505 and female 510 elements to one another thus enabling the aforementioned three electrical communications. Wherein operationally separating the male 505 and female 510 elements requires a reverse turning 520 of the male element 505 relative to the female element 510 which disconnects the three aforementioned electrical communications due to the circumferential positioning of the primary 580, secondary 585, and tertiary 590 conductor contacts in relation to the first 540, second 545, and third 550 conductor contacts as best shown in FIGS. 14A and 14B, plus see FIG. 23, after the reverse turning 520 then a reverse movement 515 along the longwise axis 240 as between the male 505 and female 510 elements that ultimately fully separate the male 505 and female 510 elements.

In looking at FIGS. 1 to 4, 6 to 10, and 15 to 19, alternatives are disclosed for use of the twist and lock removably engagable electrical plug assembly 500 that include the hair dryer 50, the flat iron 600, the curling iron 610, the crimping iron, and the hair clipper 630.

Method of Use

In looking at FIGS. 9 to 12 in particular, a method of use is disclosed for the hair dryer apparatus 50 that includes a first step of providing the hair dryer apparatus 50 as previously described, further a second step of wrapping 330 a portion of the head of hair 60 about the hair brush 65 such that the portion of the hair 60 is in contact with the bristles 70, see FIGS. 10, 12, and 12. Next, a third step of activating 335 the blower 195 to drive the airflow 320, 325 therethrough the portion of the hair 60 that is wrapped about the hair brush 65 being in contact with the bristles 70 for a selected time period, see FIGS. 10 and 11. Continuing, a fourth step of removing 340 the brush 65 from the outlet margin 125 structure 130 of the hair dryer apparatus 50 leaving the brush 65 in place with the portion of hair 60 wrapped about the brush 65 keeping the brush 65 in use upon the head of hair 60, see FIG. 12 in particular. As an optional additional step for the method of using the hair dryer apparatus 50 can further include an added step of grasping 345 an additional unused brush 65 and engaging 345 the unused brush 65 (meaning no hair 60 is wrapped about the brush 65) to the outlet margin 125 structure 130 of the hair dryer apparatus 50, see FIG. 12, then repeating the second, third, and fourth steps. This method of use allows for each of the plurality of brushes 65 to remain in place upon the head of hair 60 for the hair 60 curl to set after each of the plurality of brushes 65 has had the airflow 320, 325 to dry and start to set the hair curl while engaged to outlet margin 125 structure 130 of the hair dryer apparatus 50 while activated 335.

CONCLUSION

Accordingly, the present invention of a hair dryer apparatus has been described with some degree of particularity directed to the embodiments of the present invention. It should be appreciated, though; that the present invention is defined by the following claim construed in light of the prior art so modifications or changes may be made to the exemplary embodiments of the present invention without departing from the inventive concepts contained therein.

The invention claimed is:

1. A hair dryer apparatus comprising:

(a) a housing including a surrounding sidewall being about a longitudinal axis, said surrounding sidewall having an inner surface portion defining a sidewall interior and said surrounding sidewall having an opposing outer surface portion, said surrounding sidewall having an inlet portion and an opposing outlet portion with said longitudinal axis spanning therebetween;

(b) a motor driven blower disposed within said surrounding sidewall interior, said blower is operational to drive airflow from said inlet portion therethrough said sidewall interior to said outlet portion; and (c) a handle in the form of a clevis shape with said clevis shape having a pair of symmetrically opposed arcuate extensions that have a common origination from a handle stem extension portion, wherein said stem extension portion has an opposing free end portion, wherein each of said arcuate extensions terminate in a pivotal connection to said sidewall outer surface portion of said inlet portion, said pivotal connection includes a plurality of removably engagable teeth disposed on a rotational engagement of said clevis and a mating plurality of removably engagable teeth disposed on a rotational engagement of said outer surface, said plurality of teeth have a matingly engaged state and a disengaged state via movement along a pivotal axis facilitated by a flexible link disposed between said outer surface and said rotational engagement of said outer surface, wherein said pivotal connections are along said pivotal axis, wherein operationally said handle stem extension portion in a longwise manner along a longwise axis has a pivotal movement range from being co-axial to said longitudinal axis to being substantially perpendicular to said longitudinal axis as said pivotal movement is free when said pivotal connection is in said open state and said pivotal movement is locked when said pivotal connection is in said closed state.

2. A hair dryer apparatus according to claim 1 further comprising a button that forms a part of said outer surface removable engagement, wherein said button extends therethrough said clevis rotational engagement along said pivotal axis, wherein said button facilitating a pivotal connection as between said clevis and said outer surface rotational engagement, wherein operationally when said button is depressed causing button movement toward said outer surface resulting in moving said outer surface rotational engagement closer to said outer surface via said flexible link which takes said mating plurality of teeth from said closed state to said open state to allow said pivotal movement, wherein releasing said button urges a reverse button movement via said flexible link further separating said outer surface rotational engagement from said outer surface placing said plurality of mating teeth into said closed state to lock said pivotal movement.

3. A hair dryer apparatus according to claim 1 further comprising an electrical communication rotatable couple that is disposed at said pivotal connection that facilitates a corded electrical power communication for said motor to exit from said free end portion of said stem extension.

4. A hair dryer apparatus according to claim 3 wherein said electrical communication rotatable couple is constructed of a plurality of electrically conductive concentric slip rings that are about said pivotal axis, said slip rings are one on one slidably in contact with a plurality of corresponding electrically conductive fingers, wherein operationally said fingers slide as against said slip rings being in accordance with said pivotal movement to allow electrical communication across said pivotal connection during said pivotal movement and when said handle is static in relation to said housing.

5. A hair dryer apparatus according to claim 1 wherein said sidewall outlet portion terminates in an outlet margin wherein said outlet margin has structure to accommodate a removable engagement of a brush to said outlet margin, said brush having external bristles and having an interior void that is in fluid communication with said sidewall interior, said brush has a plurality of radial openings in relation to said longitudinal axis that allow fluid communication from said void to said bristles, wherein operationally said airflow from said blower can exit therethrough said openings to have said airflow at said bristles.

6. A hair dryer apparatus according to claim 5 wherein said brush to outlet margin removable engagement is constructed of a hex receptacle disposed in said outlet margin that receives a hex protrusion on said brush, further said hex protrusion includes a magnetic shoulder that magnetically attracts to said outlet margin to operationally retain said brush to said outlet margin however allowing separation as between said brush and said outlet margin via a manual separating pull as between said brush and said outlet margin along said longitudinal axis.

7. An electrical appliance comprising:

(a) a handle having a longwise axis and a free end portion;

(b) a twist locking removably engagable electrical plug assembly disposed on said free end portion, said electrical plug assembly includes;

(bi) a female element portion that comprises a female annular cavity that is disposed about said longwise axis, a female inner cylinder about said longwise axis that is disposed inward of said female annular cavity, and a female inner bore that is about said longwise axis disposed inward of said female inner cylinder, further included is a wide channel disposed in said female annular cavity that runs parallel to said longwise axis, wherein said wide channel terminates in a "L" shape wherein said wide channel terminates in a section that is perpendicular to said wide channel, also further included is a narrow channel disposed in said female annular cavity that runs parallel to said longwise axis, wherein said narrow channel terminates in a "L" shape wherein said narrow channel terminates in a section that is perpendicular to said narrow channel, wherein said wide and narrow "L" shapes face a same circumferential direction, further a first conductor contact and a second conductor contact are disposed in said female annular cavity, plus a third conductor contact is disposed in said female inner bore; and (bii) a male element portion that comprises a male outer diameter that forms a male outer cylinder that are both disposed about said longwise axis, a male annular cavity that is about said longwise axis that is disposed inward of said male outer cylinder, and a male cylinder that is about said longwise axis disposed inward of said male annular cavity, further included is a wide protrusion disposed on said male outer diameter, also further included is a narrow protrusion disposed on said male outer diameter, further a primary conductor contact disposed in said male annular cavity, also a secondary conductor contact disposed in said male annular cavity, plus a tertiary conductor contact disposed on said male cylinder, wherein said wide protrusion is received by said wide channel via movement along said longwise axis and said narrow protrusion is received by said narrow channel via movement along said longwise axis to facilitate a singular positional orientation as between said male and female elements, as said male element is inserted via insertion movement into said female element along said longwise axis, further when said insertion movement bottoms out said male element is rotationally turned to have said wide and narrow protrusions be respectively received into said wide and narrow "L" shapes to axially lock said male element into said female element, wherein operationally only when said axial lock is in place there is electrical communication as between said male and female elements, wherein said primary contact is in electrical communication with said first conductor contact and said secondary conductor contact is in electrical communication with said second conductor contact, plus said tertiary conductor contact is in electrical communication with said third conductor contact, all said aforementioned electrical communications require said male outside diameter to be received into said female annular cavity wherein said male cylinder inserts into said female inner bore while simultaneously matching said wide protrusion to said wide channel and said narrow protrusion to said narrow channel and finally turning said male element in said female element to axially lock said male and female elements to one another thus enabling said aforementioned three electrical communications, wherein operationally separating said male and female elements requires a reverse turning of said male element which disconnects said three electrical communications and a reverse movement along said longwise axis as between said male and female elements that ultimately fully separate said male and female elements.

8. An electrical appliance according to claim 7 wherein said handle is part of a hair dryer.

9. An electrical appliance according to claim 7 wherein said handle is part of a flat iron.

10. An electrical appliance according to claim 7 wherein said handle is part of a curling iron.

11. An electrical appliance according to claim 7 wherein said handle is part of a crimping iron.

12. An electrical appliance according to claim 7 wherein said handle is part of a hair clipper.

* * * * *